US010118083B2

(12) United States Patent
Ford et al.

(10) Patent No.: US 10,118,083 B2
(45) Date of Patent: Nov. 6, 2018

(54) PORTABLE SNOW SPORTS EQUIPMENT LOCKER

(71) Applicant: Brandon J. Ford, Vail, CO (US)

(72) Inventors: Brandon J. Ford, Vail, CO (US); Keith L. Poulson, Arvada, CO (US)

(73) Assignee: Brandon J. Ford, Vail, CO (US)

( * ) Notice: Subject to any disclaimer, the term of this patent is extended or adjusted under 35 U.S.C. 154(b) by 0 days.

(21) Appl. No.: 14/229,689

(22) Filed: Mar. 28, 2014

(65) Prior Publication Data

US 2014/0291976 A1 Oct. 2, 2014

Related U.S. Application Data

(60) Provisional application No. 61/806,662, filed on Mar. 29, 2013.

(51) Int. Cl.
*A63C 11/02* (2006.01)
*A63C 11/00* (2006.01)

(52) U.S. Cl.
CPC ..... *A63C 11/023* (2013.01); *A63C 11/026* (2013.01)

(58) Field of Classification Search
CPC ..... A63C 11/00; A63C 11/02; A63C 11/007; A63C 11/009; A63C 11/023; A63C 11/026–11/028; B60R 9/12
USPC ..... 224/917, 917.5
See application file for complete search history.

(56) References Cited

U.S. PATENT DOCUMENTS 910,108 A * 1/1909 Alston ..... B65D 85/20 206/443
2,234,487 A 3/1941 Davis
3,330,573 A * 7/1967 Sieloff ..... A63C 11/028 211/70.5
3,837,548 A 9/1974 Nerger
3,917,137 A * 11/1975 Wilkins ..... A63C 11/025 224/324
3,921,871 A * 11/1975 Heil ..... A63C 11/027 220/8
4,084,735 A 4/1978 Kappas
4,161,268 A 7/1979 Heil
4,217,999 A 8/1980 Forsman
(Continued)

*Primary Examiner* — James A Shriver, II
*Assistant Examiner* — Vaughn Coolman
(74) *Attorney, Agent, or Firm* — Polson Intellectual Property Law, PC; Christopher Sylvain

(57) ABSTRACT

A portable snow sports equipment locker is disclosed. The portable snow sports equipment locker features a varying depth and tapered shape. A pair of doors allows access to the interior of the portable snow sports equipment locker. Optional wheels assist in transport of the portable storage locker. Various interior pockets and straps organize equipment. A lock holds skis and/or snowboards in place. An optional boot bag offers separate storage for boots and provides an additional mechanism for holding skis and/or snowboards in place. A telescoping embodiment allows portable snow sports equipment locker to assume either a collapsed or extended configuration. The size of the disclosed portable snow sports equipment locker offers ample room for skis/snowboards, and related equipment while remaining within the size limits for conventional freight charges. The rigid construction provides protection for stored equipment, while also allowing convenient storage and access options.

11 Claims, 19 Drawing Sheets

(56) References Cited

U.S. PATENT DOCUMENTS 4,238,063 A * 12/1980 O'Dair ..... A63C 11/027 206/315.1
4,358,137 A * 11/1982 Gramm ..... A63C 11/026 206/315.1
D267,443 S * 1/1983 Salas ..... D3/261
D293,626 S * 1/1988 Beran ..... D3/290
4,842,289 A * 6/1989 Samuels ..... A63C 11/009 280/47.19
D302,902 S 8/1989 Kaufman
D305,831 S 2/1990 Vanderhorst
4,905,827 A * 3/1990 Kim ..... A63B 55/00 206/315.3
4,953,773 A * 9/1990 Wirth ..... A63C 11/027 206/315.1
4,955,519 A 9/1990 Forrester
D312,726 S * 12/1990 Kline ..... 224/624
5,002,185 A * 3/1991 Schurman ..... A63B 55/005 206/315.3
5,005,743 A * 4/1991 Ramsay ..... A45C 7/0031 190/104
5,012,921 A * 5/1991 Becker ..... A63C 11/023 206/315.1
5,096,104 A * 3/1992 Wirth ..... A63C 11/027 206/315.1
5,160,075 A 11/1992 Moscovitch
D332,695 S 1/1993 Moscovitch
5,207,723 A * 5/1993 Newby, Sr. ..... B25H 3/00 280/47.19
5,215,318 A * 6/1993 Capraro ..... A45C 5/14 280/1.5
5,285,942 A * 2/1994 Wills ..... A63C 11/026 220/4.22
5,415,333 A * 5/1995 Wills ..... A63C 11/026 224/309
D367,169 S 2/1996 Vincent
5,509,589 A * 4/1996 Kliot ..... A43B 5/0425 224/637
5,538,137 A * 7/1996 Deioma ..... A63C 11/025 190/109
5,582,290 A * 12/1996 McCuaig ..... A63B 55/00 206/315.3
D379,870 S 6/1997 Moneta
D392,801 S 3/1998 Hields et al.
5,758,770 A 6/1998 Moneta
5,799,848 A * 9/1998 Wills ..... A63C 11/026 224/328
5,799,915 A * 9/1998 Morey ..... A63C 11/028 248/201
6,164,425 A * 12/2000 Latshaw ..... A45C 5/14 190/108
6,311,883 B1 11/2001 Greenberg
6,330,944 B1 * 12/2001 DeMichele ..... A63B 55/005 206/278
6,729,489 B2 * 5/2004 Sanderson ..... A01K 97/08 206/315.4
7,222,733 B2 * 5/2007 Kim ..... A63B 55/00 206/315.3
7,575,138 B2 * 8/2009 Lindberg ..... A45C 7/0063 224/645
8,141,905 B2 3/2012 Ball
8,381,930 B2 * 2/2013 Boyles ..... A01K 97/08 206/315.3
D718,527 S * 12/2014 Enes ..... D3/261
D725,453 S * 3/2015 Lodato ..... D8/91
2002/0060194 A1 * 5/2002 Reiser ..... A63C 11/028 211/4
2010/0038198 A1 2/2010 Jarvis
2011/0180575 A1 * 7/2011 Abramowitz ..... A45F 3/04 224/259
2015/0210221 A1 * 7/2015 Fritsche ..... B60R 9/055 224/328

* cited by examiner

PORTABLE SNOW SPORTS EQUIPMENT LOCKER

CROSS-REFERENCE TO RELATED APPLICATIONS

This application is a non-provisional application claiming the benefits of U.S. provisional application No. 61/806,662 filed Mar. 29, 2013, the disclosure of which is hereby incorporated by reference for all purposes.

BACKGROUND

Carrying cases for skis and other snow sports equipment are well known. Most of these cases are intended solely for the transportation, and occasionally storage, of skis. Many such cases are not large enough to store other than very small related sports equipment, such as gloves or goggles. They cannot hold bulkier items, such as helmets, boots and ski clothing. In other words, other similar carrying cases cannot hold all of at least one user's ski and/or snowboard equipment, including all related gear, such as gloves, goggles, helmets, boots and ski clothing. Stated differently, most existing ski cases are intended for use as luggage, useful only for airline travel and transportation from one location to another. These existing ski cases offer limited protection to ski equipment, and are difficult to maneuver in crowded locations. Significantly, existing cases do not offer convenient 'wardrobe'-type storage of ski equipment and gear, permitting easy access to these items for daily use, nor are existing cases designed with shipping in mind.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above described problems have been reduced or eliminated, while other embodiments are directed to other improvements.

The disclosed portable snow sports equipment locker offers many advantages over other products. Its rigid construction provides protection for the contents of the locker. The size offers ample room for skis, snowboards, and related equipment while remaining within the size limits for conventional low-cost freight charges. It is also appropriately sized for traveling as a single piece of luggage. It is also appropriately sized for shipping through standard package delivery services, such as FedEx and United Parcel Service (UPS). Moreover, the disclosed portable snow sports equipment locker is sized to be shipped at standard rates, not oversize rates. Numerous handles allow for differing carrying configurations. Optional wheels allow the entire case to be rolled. A molded back panel offers additional protection for the case. The case can be easily mounted to a vehicle roof rack for travel. An optional pouch carries shipping information or owner contact information. Moreover, the size of the portable snow sports equipment locker can vary to reduce shipping costs when the portable snow sports equipment locker is empty, or is carrying less equipment.

The shape of the locker, combined with the rigid construction allows it to stand up vertically for storage, much like a traditional wardrobe. In one embodiment, the portable snow sports equipment locker utilizes a double-door design, which allows a user to quickly and easily access the contents of the locker, whether it is in an upright or horizontal position. An internal lock holds skis and/or snowboards in place, preventing damage during shipping and storage. Internal racks, straps and compartments keep equipment and clothes organized and separated, making it convenient for the user. An internal protective material protects equipment from damage. An optional lined goggle compartment prevents scratches to goggle lenses during transport and storage. An optional boot bag further separates and protects ski and/or snowboard boots. This optional boot bag includes an element or portion or section to interact with skis and/or snowboards to further lock the equipment in place.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
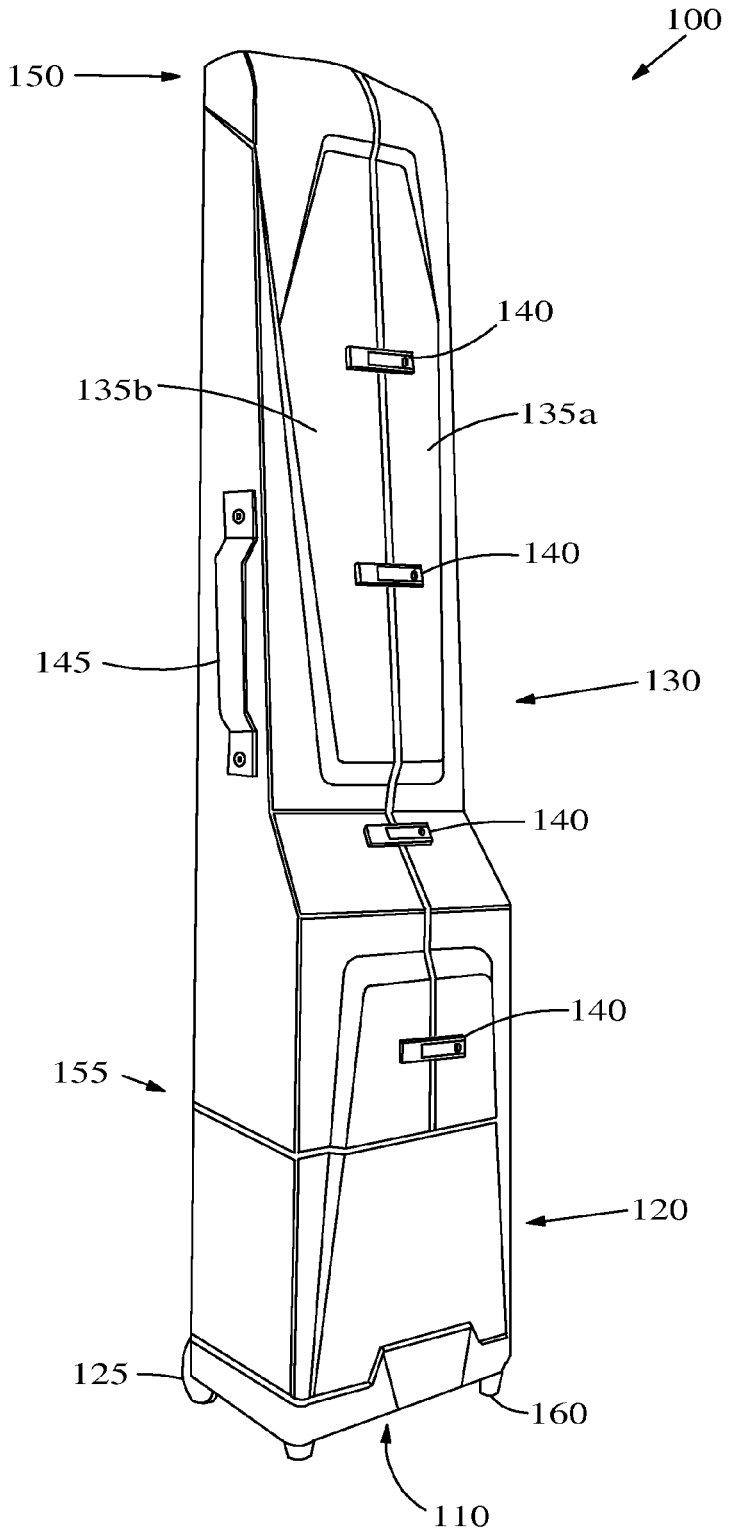
FIG. 1 is a front perspective view of a first embodiment of a portable snow sports equipment locker according to the present disclosure.

Turning first to FIG. 1, a first embodiment of a portable snow sports equipment locker 100 according to the present disclosure is shown. Portable snow sports equipment locker 100 includes a base portion or section 110, a lower portion or section 120 and an upper portion or section 130. Base portion or section 110 includes two rear wheels 125. While two wheels are shown, a portable snow sports equipment locker of the present disclosure may include four wheels, or no wheels, based on user needs and preference. Base portion or section 110 also includes two legs 160, which allow portable snow sports equipment locker 100 to remain substantially level when in an upright position. Legs 160 would not be necessary when portable snow sports equipment locker 100 includes four wheels or no wheels.

Upper portion or section 130 comprises a varying depth, wherein the smallest depth is at the top 150 of upper portion or section 130 and the largest depth is at the bottom 155 of upper portion or section 130. This varying depth allows for the larger depth of lower portion or section 120 while maintaining a smaller depth at the top 150 of upper portion or section 130. The varying depth allows portable snow sports equipment locker 100 to maintain dimensions within the dimensional standards for standard shipping rates of major delivery companies, while still providing ample internal space. Upper portion or section 130 includes a set of doors 135*a*, 135*b*. Doors 135*a*, 135*b* extend the length of upper portion or section 130. While doors 135*a*, 135*b* are depicted extending the length of upper portion or section 130, doors 135*a*, 135*b* could be shorter or longer and still be within the scope of the present disclosures. A series of latches 140 secure doors 135*a*, 135*b* in a closed position. While latches are depicted, a number of known locking devices, such as locks, clips and buckles could be used and still be within the scope of the present disclosure. The embodiment disclosed in FIG. 1 includes four closures, but one having a level of ordinary skill in the art will understand that more or less closures could be used to accomplish the objective of retaining the doors in a closed position. Upper portion or section also includes handles 145. In FIG. 1, only one handle 145 is visible. An identical handle 145 is located on the opposite door 135*b*. A handle 135 (not visible) is also included at the top 150 of upper portion or section 130. Handles 145 aid in transporting portable snow sports equipment locker 100. Handles 145 can comprise a number of known configurations.

In one embodiment, doors are chamber doors, wherein the doors are L-shaped. Doors 135*a*, 135*b* have attachment devices such as compartments or straps that allow the interior surface of the doors to be used for storage.

Optionally, base portion or section 110 may be a solid monocoque to provide additional protection for the boot bag and tails of the skis. Exemplary dimensions may include a total volume of 5130 cubic inches.

Figure 2:
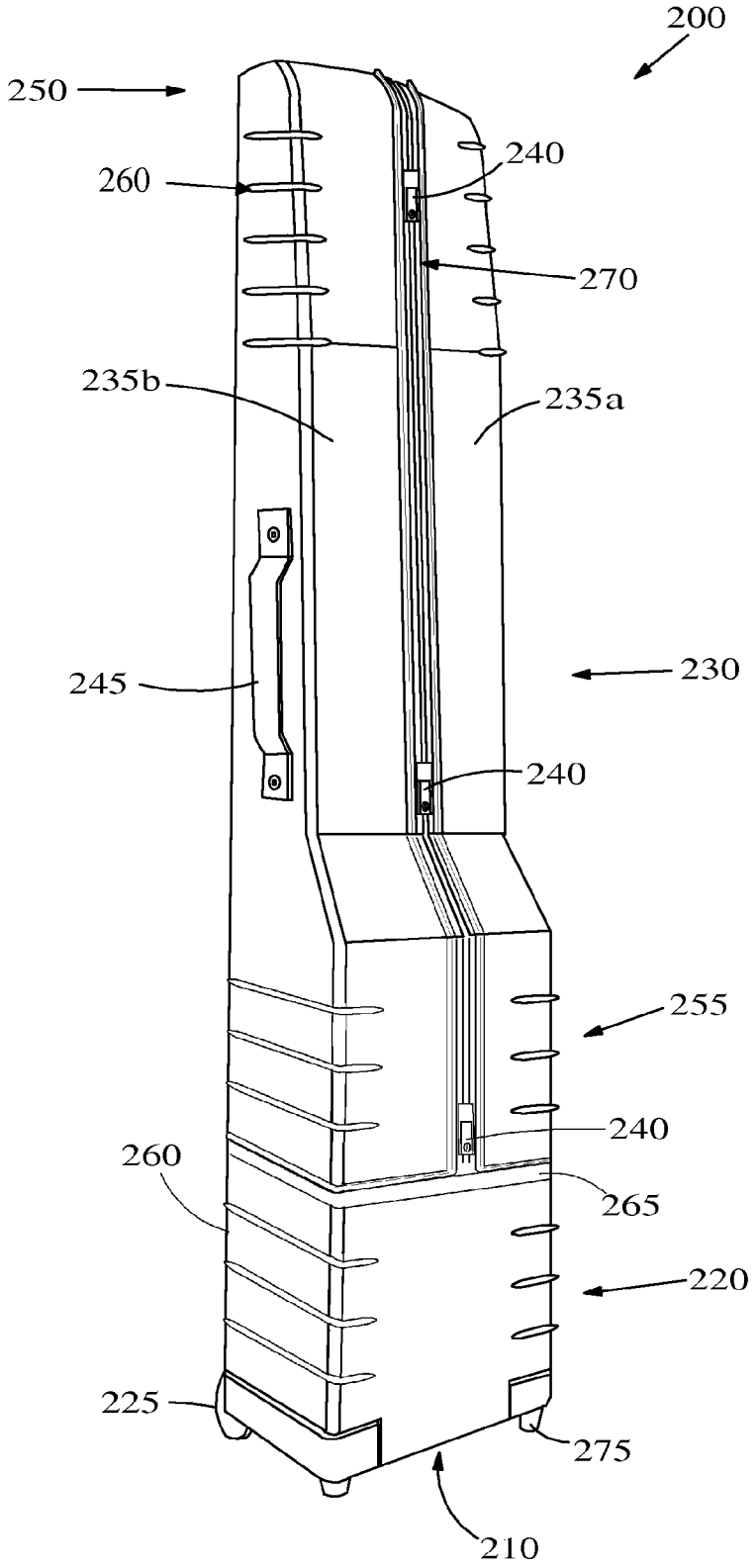
FIG. 2 is a front perspective view of a second embodiment of a portable snow sports equipment locker according to the present disclosure.

Turning next to FIG. 2, an alternate embodiment of a portable snow sports equipment locker 200 is shown. Portable snow sports equipment locker 200 comprises a base portion or section 210, a lower portion or section 220 and an upper portion or section 230. Base portion or section 210 includes two rear wheels 225. While two wheels are shown, a portable snow sports equipment locker of the present disclosure may include four wheels, or no wheels, based on user needs and preference. Base portion or section 210 also includes two legs 275, which allow portable snow sports equipment locker 200 to remain substantially level when in an upright position. Legs 275 are unnecessary when portable snow sports equipment locker 200 includes four wheels or no wheels.

Lower portion or section 220 includes a set of horizontal ridges 260. Ridges 260 act as bumpers, absorbing minor impacts and further protecting portable snow sports equipment locker 200 and, by extension, its contents. In the depicted embodiment, a decorative band 265 separates lower portion or section 220 and upper portion or section 230.

Upper portion or section 230 comprises a varying depth, wherein the smallest depth is at the top 250 of upper portion or section 230 and the largest depth is at the bottom 255 of upper portion or section 230. This varying depth allows for the larger depth of lower portion or section 220 while maintaining a smaller depth at the top 250 of upper portion or section 230. The varying depth allows portable snow sports equipment locker 200 to maintain dimensions within the dimensional standards for standard shipping rates of major delivery companies, while still providing ample internal space. Upper portion or section 230 includes a set of doors 235*a*, 235*b*. Doors 235*a*, 235*b* extend the length of upper portion or section 230. While doors 235*a*, 235*b* extend the length of upper portion or section 230 in the depicted embodiment, doors 235*a*, 235*b* could be longer or shorter and still be within the scope of the present disclosure. A series of latches 240 secure doors 235*a*, 235*b* in a closed position. In the depicted embodiment, latches 240 are mounted in a recess 270. Recess 270 offers additional protection to latches 240. While latches are depicted, a number of known locking devices, such as locks, clips and buckles could be used and still be within the scope of the present disclosure. The embodiment disclosed in FIG. 2 includes four closures, but one having a level of ordinary skill in the art will understand that more or less closures could be used to accomplish the objective of retaining the doors in a closed position. The embodiment disclosed in FIG. 2 represents an alternate configuration of latches than those displayed in FIG. 1. One having an ordinary level of skill in the art will understand that the alternate configurations are interchangeable.

Upper portion or section 230 also includes handles 245. In FIG. 2, only one handle 245 is visible. An identical handle 245 is located on the opposite door 235*b*. A handle 235 (not visible) is also included at the top 250 of upper portion or section 230. Handles 245 aid in transporting portable snow sports equipment locker 200. Handles 245 can comprise a number of known configurations. A series of horizontal ridges 260 are present near the top 250 and bottom 255 of upper potion 230. Ridges 260 act as bumpers which absorb minor impacts and offer further protection to portable snow sports equipment locker 200 and its contents.

Figure 3:
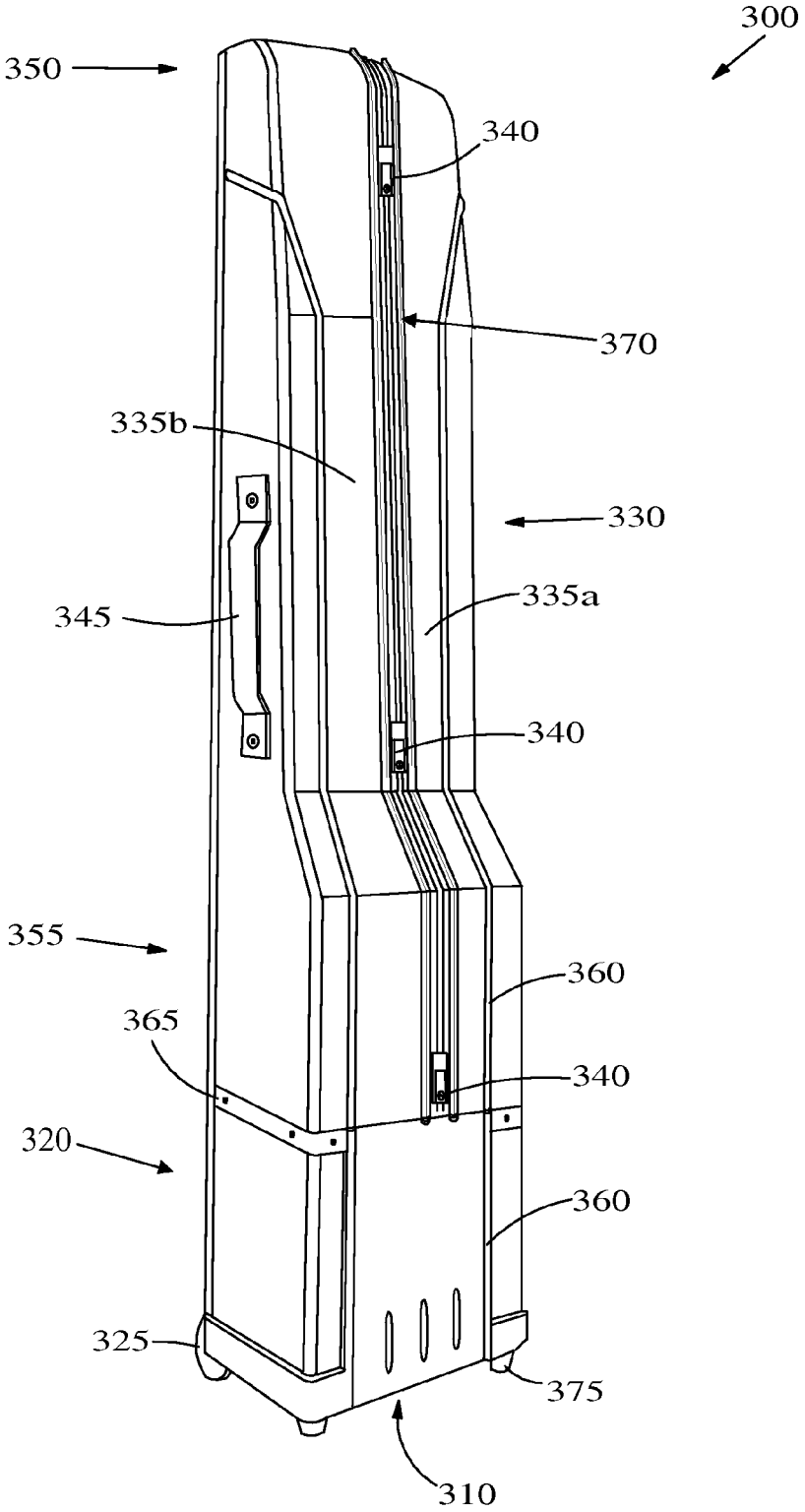
FIG. 3 is a front perspective view of a third embodiment of a portable snow sports equipment locker according to the present disclosure.
Figure 4:
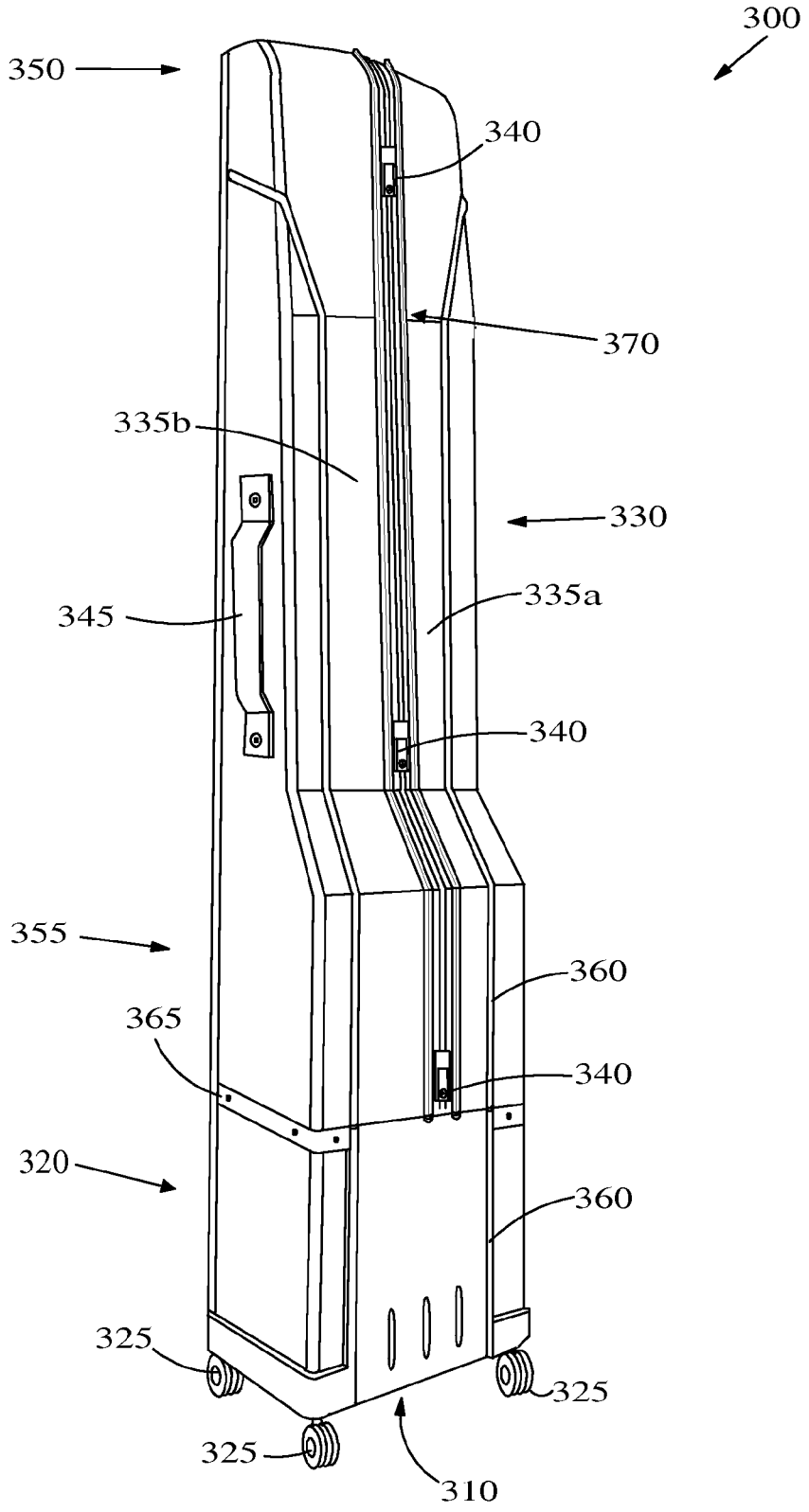
FIG. 4 is a front perspective view of a third embodiment of a portable snow sports equipment locker according to the present disclosure.

Turning next to FIGS. 3 and 4, an alternate embodiment of a portable snow sports equipment locker 300 is shown. Portable snow sports equipment locker 300 comprises a base portion or section 310, a lower portion or section 320 and an upper portion or section 330. In FIG. 3, base portion or section 310 includes two rear wheels 325. In FIG. 4, base portion or section 310 includes four wheels 325. While two wheel and four wheel combinations are shown, a portable snow sports equipment locker of the present disclosure may include no wheels. One having an ordinary level of skill in the art will understand that the presence or absence of wheels, and number thereof, is interchangeable based upon user needs and preference. In FIG. 3, base portion or section 310 includes two legs 375, which allow portable snow sports equipment locker 300 to remain substantially level when in an upright position. Legs 375 are unnecessary when portable snow sports equipment locker 300 includes four wheels, as depicted in FIG. 4, or no wheels.

Lower portion or section 320 and upper portion or section 330 include a set of generally vertical ridges 360. Ridges 360 act as bumpers, absorbing minor impacts and further protecting portable snow sports equipment locker 300 and, by extension, its contents. In the depicted embodiment, a decorative band 365 separates lower portion or section 320 and upper portion or section 330.

Upper portion or section 330 comprises a varying depth, wherein the smallest depth is at the top 350 of upper portion or section 330 and the largest depth is at the bottom 355 of upper portion or section 230. This varying depth allows for the larger depth of lower portion or section 320 while maintaining a smaller depth at the top 350 of upper portion or section 330. The varying depth allows portable snow sports equipment locker 300 to maintain dimensions within the dimensional standards for standard shipping rates of major delivery companies, while still providing ample internal space. Upper portion or section 330 includes a set of doors 335*a*, 335*b*. Doors 335*a*, 335*b* extend the length of upper portion or section 330. While doors 335*a*, 335*b* are depicted as extending the length of upper portion or section 330, doors 335*a*, 335*b* could be shorter or longer and still be within the scope of the present disclosure. A series of latches 340 secure doors 335*a*, 335*b* in a closed position. In the depicted embodiment, latches 340 are mounted in a recess 370. Recess 370 offers additional protection to latches 340. While latches are depicted, a number of known locking devices, such as locks, clips and buckles could be used and still be within the scope of the present disclosure. The embodiment disclosed in FIGS. 3 and 4 includes three closures, but one having a level of ordinary skill in the art will understand that more or less could be used to accomplish the objective of retaining the doors in a closed position.

Upper portion or section 330 also includes handles 345. In FIGS. 3 and 4, only one handle 345 is visible. An identical handle 345 is located on the opposite door 335*b*. A handle 335 (not visible) is also included at the top 350 of upper portion or section 330. Handles 345 aid in transporting portable snow sports equipment locker 300. Handles 345 can comprise a number of known configurations.

Figure 5:
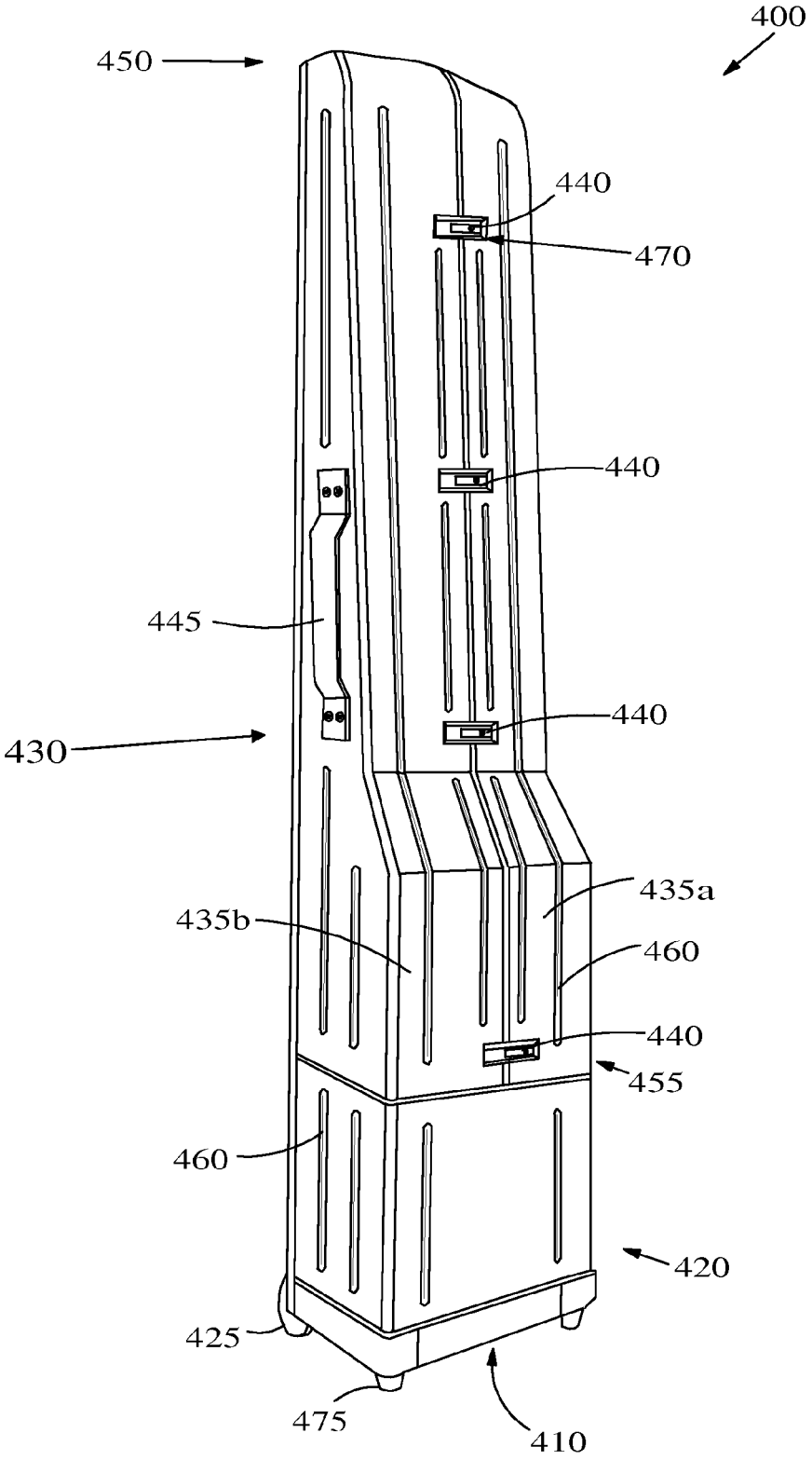
FIG. 5 is a front perspective view of a fourth embodiment of a portable snow sports equipment locker according to the present disclosure.
Figure 6:
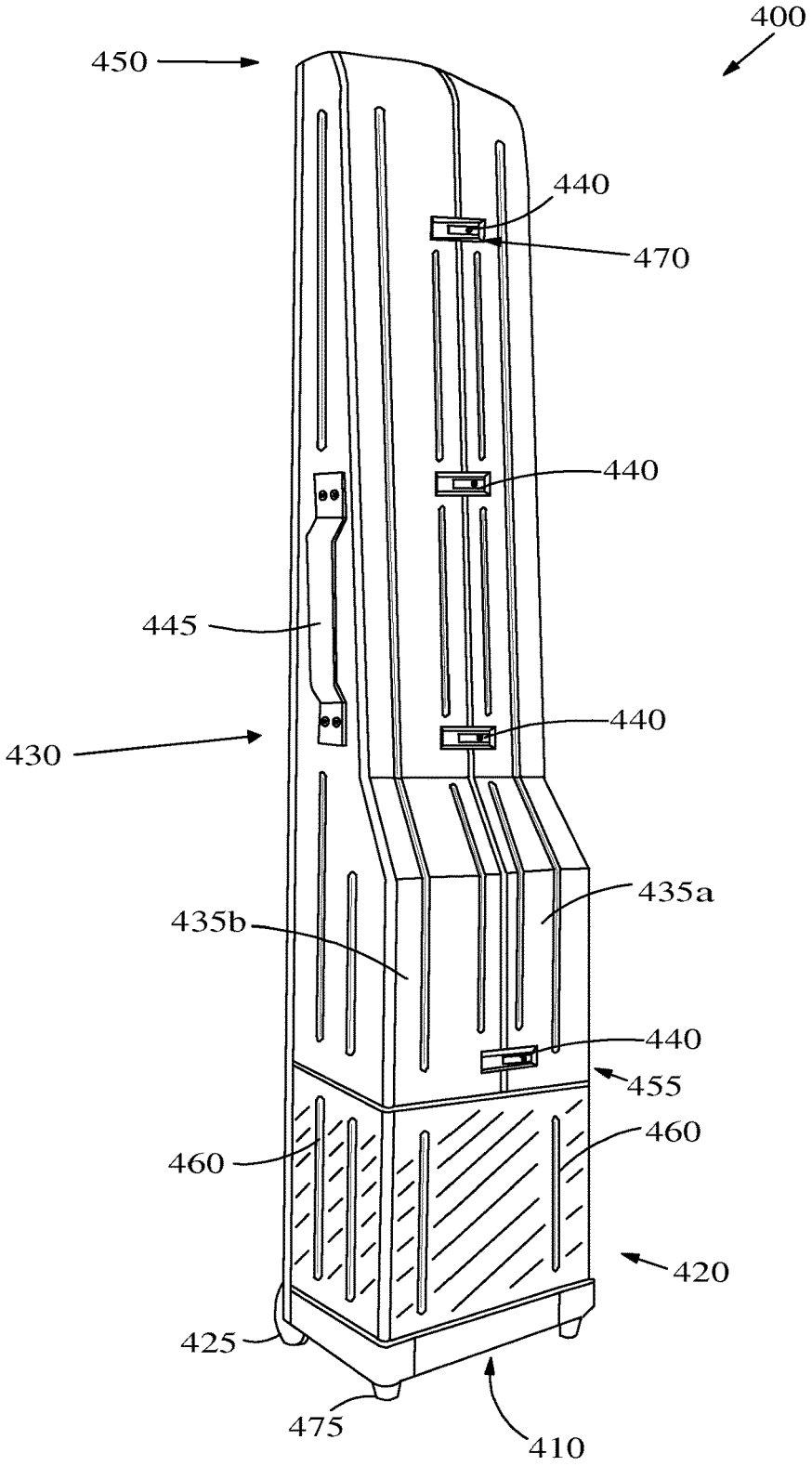
FIG. 6 is a front perspective view of a fourth embodiment of a portable snow sports equipment locker according to the present disclosure.

Turning next to FIGS. 5 and 6, an alternate embodiment of a portable snow sports equipment locker 400 is shown. Portable snow sports equipment locker 400 comprises a base portion or section 410, a lower portion or section 420 and an upper portion or section 430. Base portion or section 410 includes two rear wheels 425. While a two wheel configuration is shown, a portable snow sports equipment locker of the present disclosure may include four wheels, or, alternatively, no wheels. One having an ordinary level of skill in the art will understand that the presence or absence of wheels, and number thereof, is interchangeable based upon user needs and preference. Base portion or section 410 includes two legs 475, which allow portable snow sports equipment locker 400 to remain substantially level when in an upright position. Legs 475 are unnecessary when portable snow sports equipment locker 400 includes four wheels or no wheels.

Lower portion or section 420 and upper portion or section 430 include a set of generally vertical ridges 460 on their respective front and side faces. Ridges 460 act as bumpers, absorbing minor impacts and further protecting portable snow sports equipment locker 400 and, by extension, its contents.

Upper portion or section 430 comprises a varying depth, wherein the smallest depth is at the top 450 of upper portion or section 430 and the largest depth is at the bottom 455 of upper portion or section 430. This varying depth within upper portion or section 430 allows for the larger depth of lower portion or section 420 while maintaining a smaller depth at the top 450 of upper portion or section 430. The varying depth allows portable snow sports equipment locker 400 to maintain dimensions within the dimensional standards for standard shipping rates of major delivery companies, while still providing ample internal space. Upper portion or section 430 includes a set of doors 435*a*, 435*b*. Doors 435*a*, 435*b* extend the length of upper portion or section 430. While doors 435*a*, 435*b* are depicted as extending the length of upper portion or section 430, doors 435*a*, 435*b* could be shorter or longer and still be within the scope of the present disclosure. A series of latches 440 secure doors 435*a*, 435*b* in a closed position. In the depicted embodiment, latches 440 are mounted in individual recesses 470. Recesses 470 offer additional protection to latches 440. While latches are depicted, a number of known locking devices, such as locks, clips and buckles could be used and still be within the scope of the present disclosure. The embodiment disclosed in FIGS. 5 and 6 includes four closures, but one having a level of ordinary skill in the art will understand that more or less could be used to accomplish the objective of retaining the doors in a closed position.

Upper portion or section 430 also includes handles 445. In FIGS. 5 and 6, only one handle 445 is visible. An identical handle 445 is located on the opposite door 435*b*. A handle 435 (not visible) is also included at the top 450 of upper portion or section 430. Handles 445 aid in transporting portable snow sports equipment locker 400. Handles 445 can comprise a number of known configurations.

Figure 7:
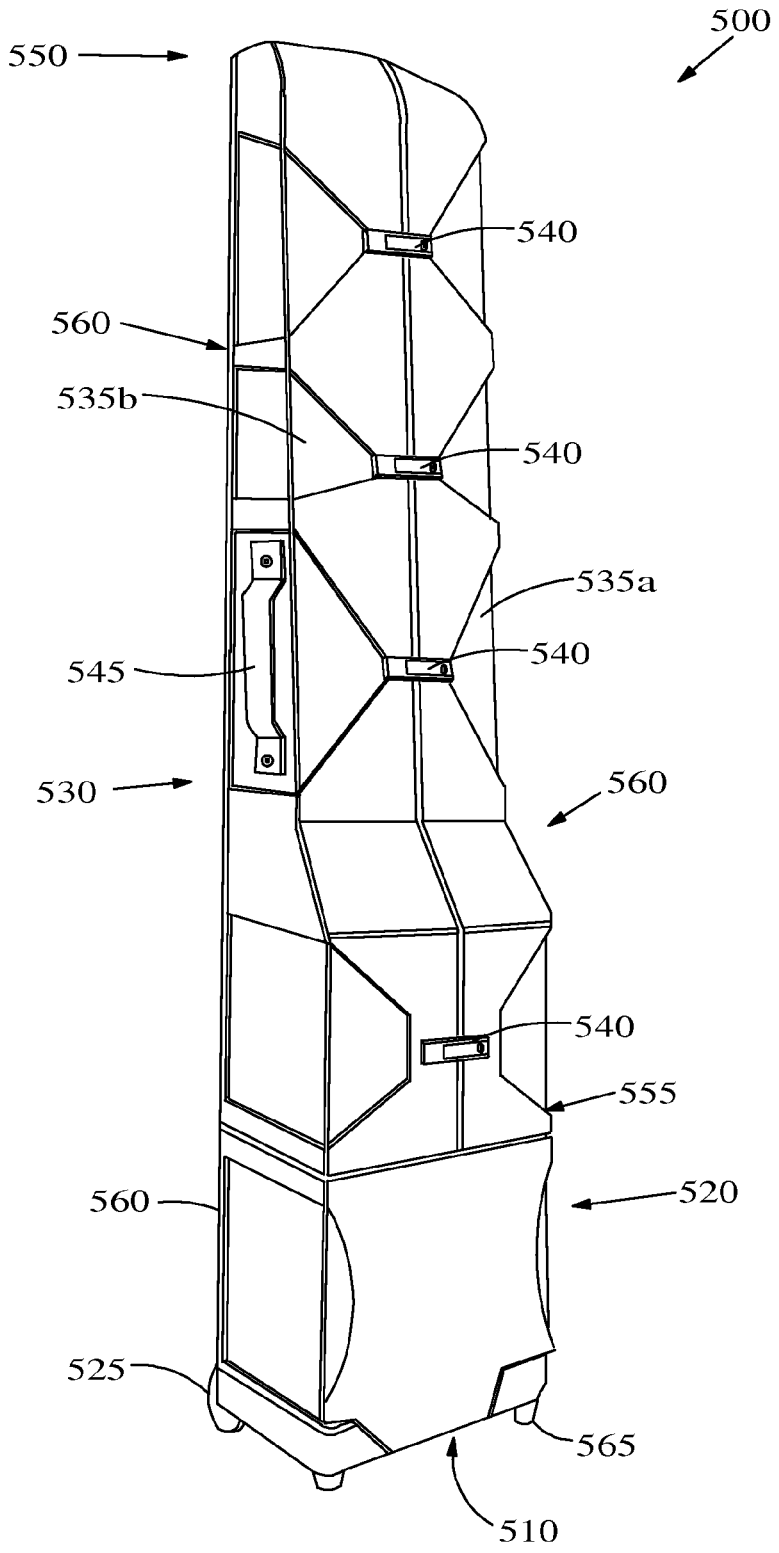
FIG. 7 is a front perspective view of a fifth embodiment of a portable snow sports equipment locker according to the present disclosure.

Turning next to FIG. 7, an alternate embodiment of a portable snow sports equipment locker 500 is shown. Portable snow sports equipment locker 500 comprises a base portion or section 510, a lower portion or section 520 and an upper portion or section 530. Base portion or section 510 includes two rear wheels 525. While two wheels are shown, a portable snow sports equipment locker of the present disclosure may include four wheels, or, in the alternative, no wheels. One having an ordinary level of skill in the art will understand that the presence or absence of wheels, and number thereof, is interchangeable based upon user needs and preference. Base portion or section 510 includes two legs 565, which allow portable snow sports equipment locker 500 to remain substantially level when in an upright position. Legs 565 are unnecessary when portable snow sports equipment locker 500 includes four wheels or no wheels.

Lower portion or section 520 and upper portion or section 530 include a series of raised portions 560. Raised portions 560 are both decorative and functional, acting as bumpers to absorb minor impacts and offering an additional layer of protection to portable snow sports equipment locker 500 and, by extension, its contents.

Upper portion or section 530 comprises a varying depth, wherein the smallest depth is at the top 550 of upper portion or section 530 and the largest depth is at the bottom 555 of upper portion or section 530. This varying depth within upper portion or section 530 allows for the larger depth of lower portion or section 520 while maintaining a smaller depth at the top 550 of upper portion or section 530. The varying depth allows portable snow sports equipment locker 500 to maintain dimensions within the dimensional standards for standard shipping rates of major delivery companies, while still providing ample internal space. Upper portion or section 530 includes a set of doors 535*a*, 535*b*. Doors 535*a*, 535*b* extend the length of upper portion or section 530. A series of latches 540 secure doors 535*a*, 535*b* in a closed position. While doors 535*a*, 535*b* are depicted as extending the length of upper portion or section 530, doors 535*a*, 535*b* could be shorter or longer and still be within the scope of the present disclosure. A series of latches 540 secure doors 535*a*, 535*b* in a closed position While latches are depicted, a number of known locking devices, such as locks, clips and buckles could be used and still be within the scope of the present disclosure. The embodiment disclosed in FIG. 7 includes four closures, but one having a level of ordinary skill in the art will understand that more or less closures could be used to accomplish the objective of retaining the doors in a closed position.

Upper portion or section 530 also includes handles 545. In FIG. 7, only one handle 545 is visible. In the depicted embodiment, handle 545 is mounted tightly to upper portion or section 530. Handle 545 has the ability to slide out to provide more room. An identical handle 545 is located on the opposite door 535*b*. A handle 535 (not visible) is also included at the top 550 of upper portion or section 530. Handles 545 assist in transporting portable snow sports equipment locker 500. Handles 545 can comprise a number of known configurations. The embodiment disclosed in FIG. 7 represents an alternate configuration of handles than those displayed in FIGS. 1-6. One having an ordinary level of skill in the art will understand that these alternate configurations are interchangeable.

Figure 8:
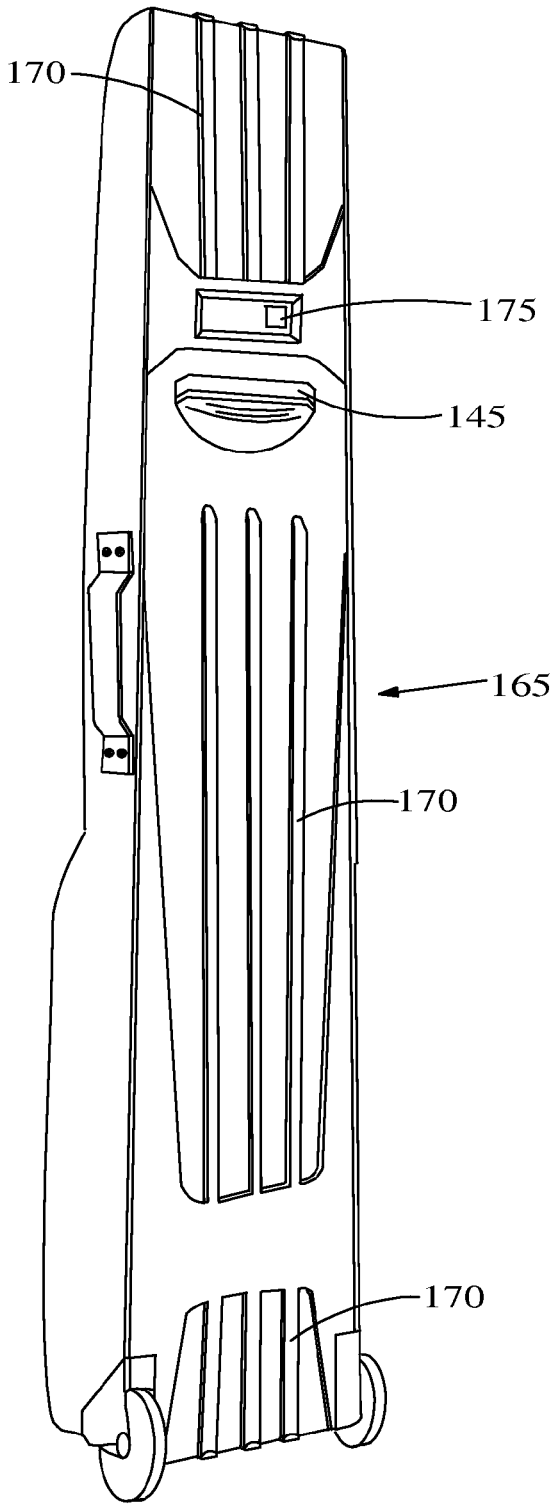
FIG. 8 is a rear perspective view of a portable snow sports equipment locker according to the present disclosure.

Turning next to FIG. 8, the rear side of portable snow sports equipment lockers 100, 200, 300, 400 and 500 is shown. Rear side 165 includes a handle 145. Handle 145 assists in transporting portable snow sports equipment locker 100, 200, 300, 400 or 500. Handle may be of either type discussed with respect to the embodiments of the portable snow sports equipment locker. Namely, it may be mounted with room underneath or it may be mounted tightly to the portable snow sports equipment locker with the ability to be pulled out to gain additional clearance between the handle and the portable snow sports equipment locker. Rear side 165 includes a series of generally vertical bumpers 170. Bumpers 170 absorb minor impacts to portable snow sports equipment locker 100, 200, 300, 400 or 500, thereby offering an additional layer of protection to the portable snow sports equipment locker and its contents. Optionally, rear side 165 may include an area 175 for mounting traveler information and/or shipping information.

The portable snow sports equipment locker depicted in FIGS. 1-8 offers numerous advantages. The portable snow sports equipment locker can be loaned to customers for transporting ski equipment to an alternate location. An empty portable snow sports equipment locker can be shipped to a customer. Upon receipt, the consumer can fill the portable snow sports equipment locker for shipping to his or her chosen destination. The portable snow sports equipment locker is then shipped via any known shipping method, which has been pre-selected by the user, using a prepaid shipping label provided with the portable snow sports equipment locker. The snow sports equipment locker is sized to ship at standard rates, not oversize rates. The consumer can elect to have the portable snow equipment locker retrieved from his or her home by the shipping company. Alternatively, the consumer can take the portable snow sports equipment locker to a shipping company's physical location for shipping. The user is then reunited with the portable snow sports equipment locker at his or her chosen location. When a consumer leaves the chosen destination, he or she simply repacks the portable snow sports equipment locker and deposits it with the shipping company, or, in the alternative, leaves it with the hotel for later shipping. Again, the consumer may utilize a prepaid shipping label. Once more, the size of the portable snow sports equipment locker will allow the consumer to take advantage of standard shipping rates, rather than oversize shipping rates. When the consumer arrives at his or her next chosen location, he or she simply unpacks the portable snow sports equipment locker and releases it to a shipping company for return. The consumer may utilize a prepaid shipping label, advantageously obtained at the standard shipping rate.

Figure 9:
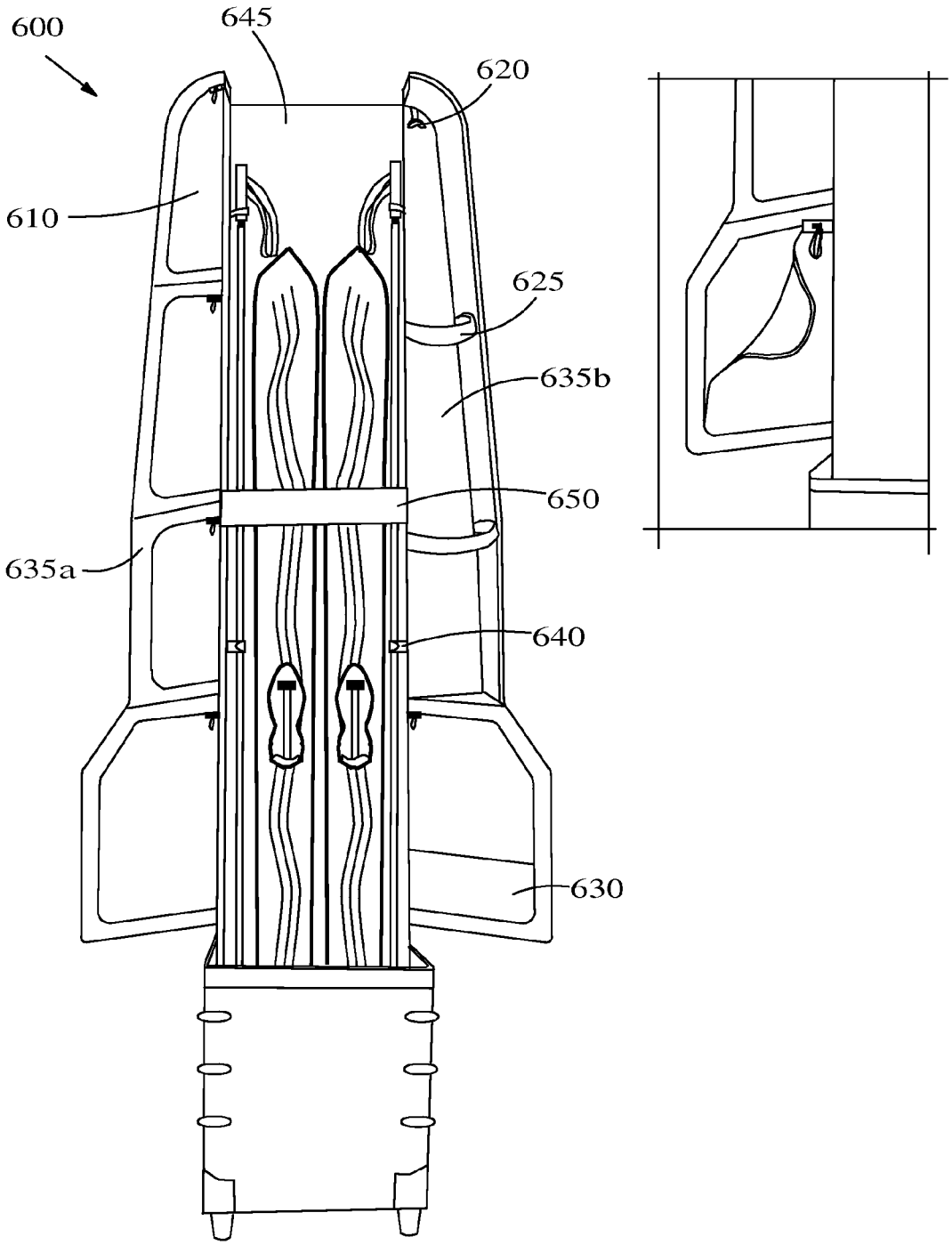
FIG. 9 is a front plan view of an interior of a portable snow sports equipment locker according to the present disclosure.
Figure 10:
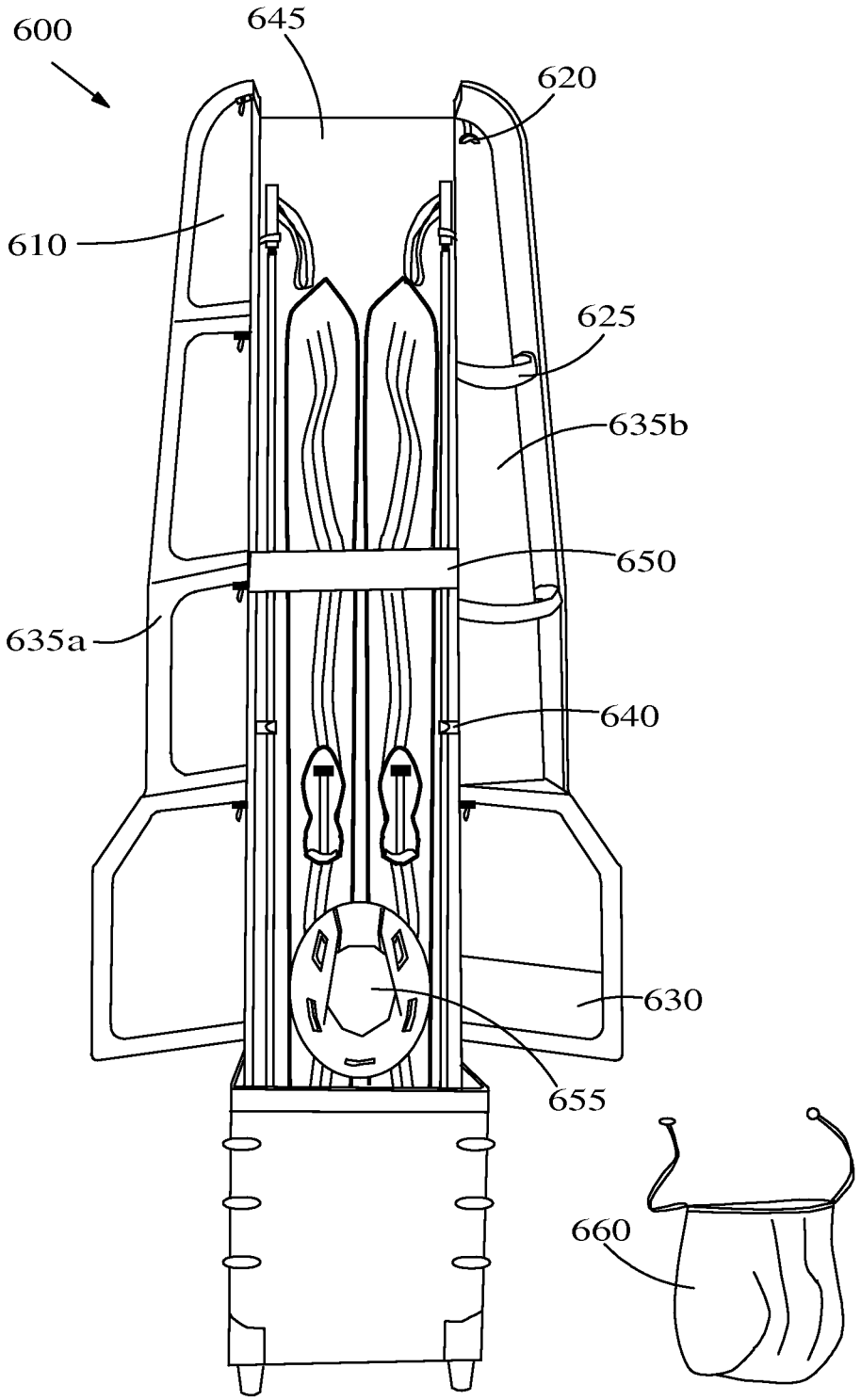
FIG. 10 is a front plan view of an alternate interior of a portable snow sports equipment locker according to the present disclosure.

FIGS. 9 and 10 depict a portable snow sports equipment locker 600 of the present disclosure with the doors open to reveal the internal configuration. A series of pockets 610 are mounted on the inside of one door 635*a*. In the depicted embodiment, pockets 610 are zippered mesh, allowing the contents to be easily ascertained. One having an ordinary level of skill in the art will understand that pockets 610 could be formed from a variety of known materials. Further, pockets 610 could be fastened in a number of known ways, such as snaps and buttons. One or more pockets 610 may be lined with fleece or a similar material to prevent scratches to the contents. The inside of a second door 635*b* includes a clip 620. Clip 620 may be used for hanging larger items, such as a jacket. The inside of second door 635*b* also includes a series of straps 625. Straps 625 may be used to further secure an item attached to clip 620 against inside of door 635*b*. In the depicted embodiment, straps 625 utilize a hook and loop closure. One having an ordinary level of skill in the art will understand that the hook and loop closure could be replaced by a number of known methods of closure, such as buckles, clips and snaps. Pockets 610 may include outer pockets 630 to store additional items. One having an ordinary of skill in the art will understand that the various internal components shown in FIGS. 9 and 10 could be configured in a number of different ways and still fall within the scope of the present disclosure. This disclosure is in no way limited to the configurations shown in FIGS. 9 and 10. The internal configuration disclosed in FIGS. 9 and 10 can apply to any embodiment of the portable snow sports equipment locker disclosed herein.

A set of straps 640 is mounted on rear wall 645 of portable snow sports equipment locker 600. In the depicted embodiment, straps 640 are used to secure a set of ski poles. In the depicted embodiment, straps 640 are fastened with a hook and loop closure. One having an ordinary level of skill in the art will understand that straps 640 could be fastened with any of a number of known closure methods, such as buckles, clips and snaps. A lock 650 is also mounted in rear wall 645. In the depicted embodiment, lock 650 is utilized to secure a pair of skis to rear wall 645. While skis are depicted, a number of other items could interact with lock 650, such as snow boards. In one embodiment, multiple sets of skis, multiple snowboards, or some combination of the two may be mounted.

FIG. 10 also discloses a clip (not shown), to which a helmet 655 is mounted. Optionally, a bag 660 may be included to contain helmet 655. In the depicted embodiment, bag 660 is mesh. One having an ordinary level of skill in the art will understand that numerous materials can be substituted for mesh.

Figure 11:
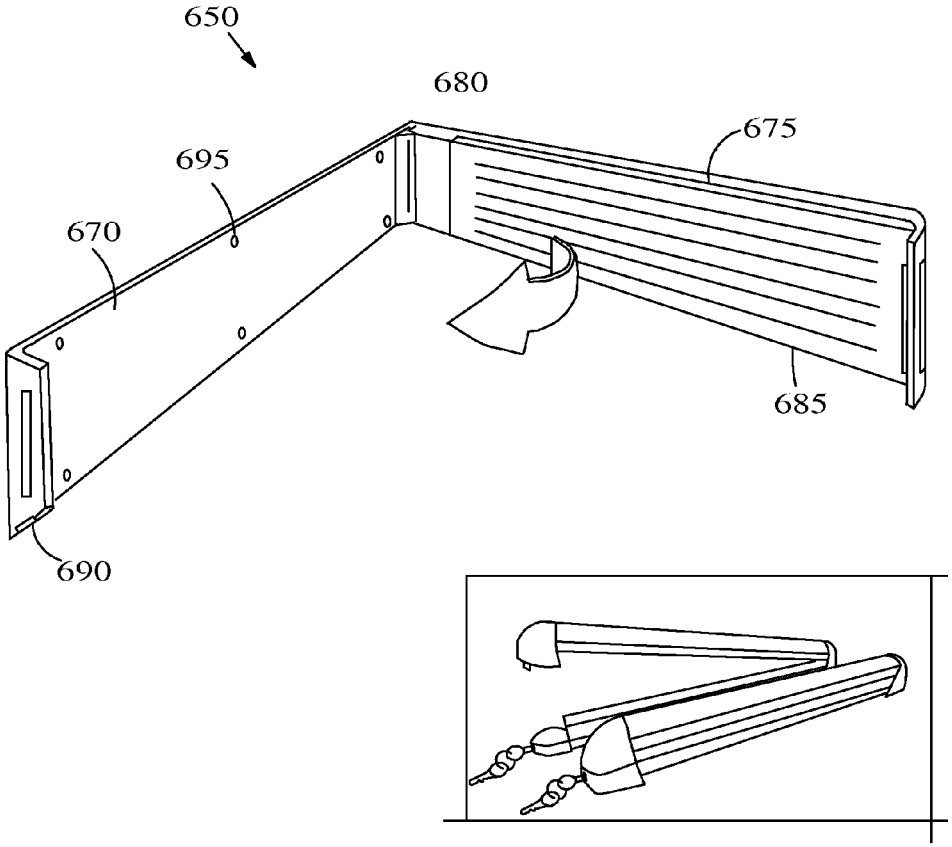
FIG. 11 is a perspective view of a lock according to the present disclosure.

FIG. 11 offers a closer view of lock 650. Lock 650 generally comprises two arms 670, 675 connected by a hinge 680. One arm 670 is attached to the back wall of a portable snow sports equipment locker. In the depicted embodiment, arm 670 is attached via six screws 695. One having an ordinary level of skill in the art will understand that numerous other methods of attachment exist, such as nails, staples, adhesives or the like, which are interchangeable with screws. Padding 685 is attached to the underside of arm 675. A lock mechanism 690 is mounted at the end of arms 670, 675 opposite hinge 680. Lock mechanism 690 can be any number of existing lock mechanisms. In one embodiment, lock mechanism 690 comprises a push button, an internal hook and an internal bar. In this configuration, push button and internal hook are connected. When arms 670, 675 are closed, internal hook releasably attaches to internal bar, thereby raising push button. When push button is depressed, internal hook releases internal bar, allowing arms 670, 675 to open. In use, skis and/or a snowboard are placed against arm 670 and arm 675 is closed over the skis and/or snowboard. Padding 685 on arm 675 protects skis and/or snowboard from damage, and also offers a more secure fit, preventing skis and/or snowboard from moving excessively. In fact, the upper portion or section of the skis will not move at all once locked into place. In the depicted embodiment, padding 685 comprises rubber, but one having an ordinary level of skill in the art will understand that a variety of materials having the same properties as rubber could be substituted.

Figure 12:
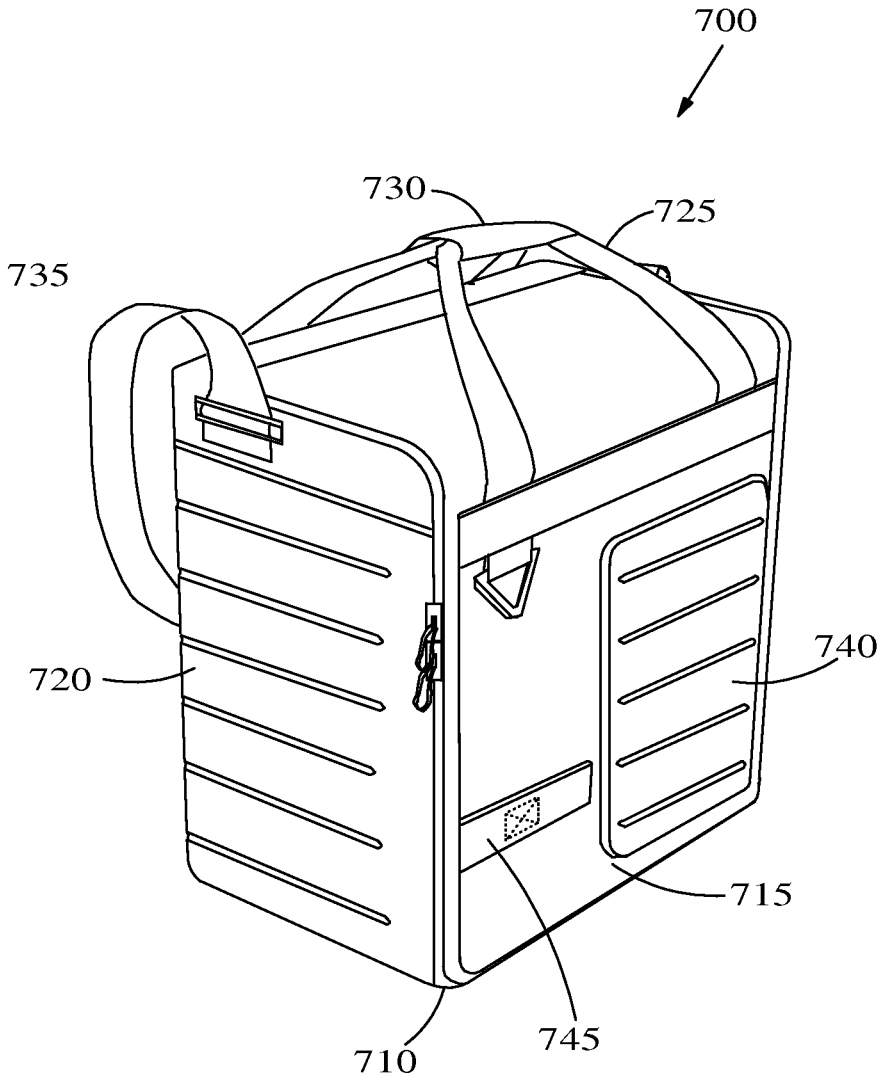
FIG. 12 is a front perspective view of a first embodiment of a boot bag according to the present disclosure.
Figure 13:
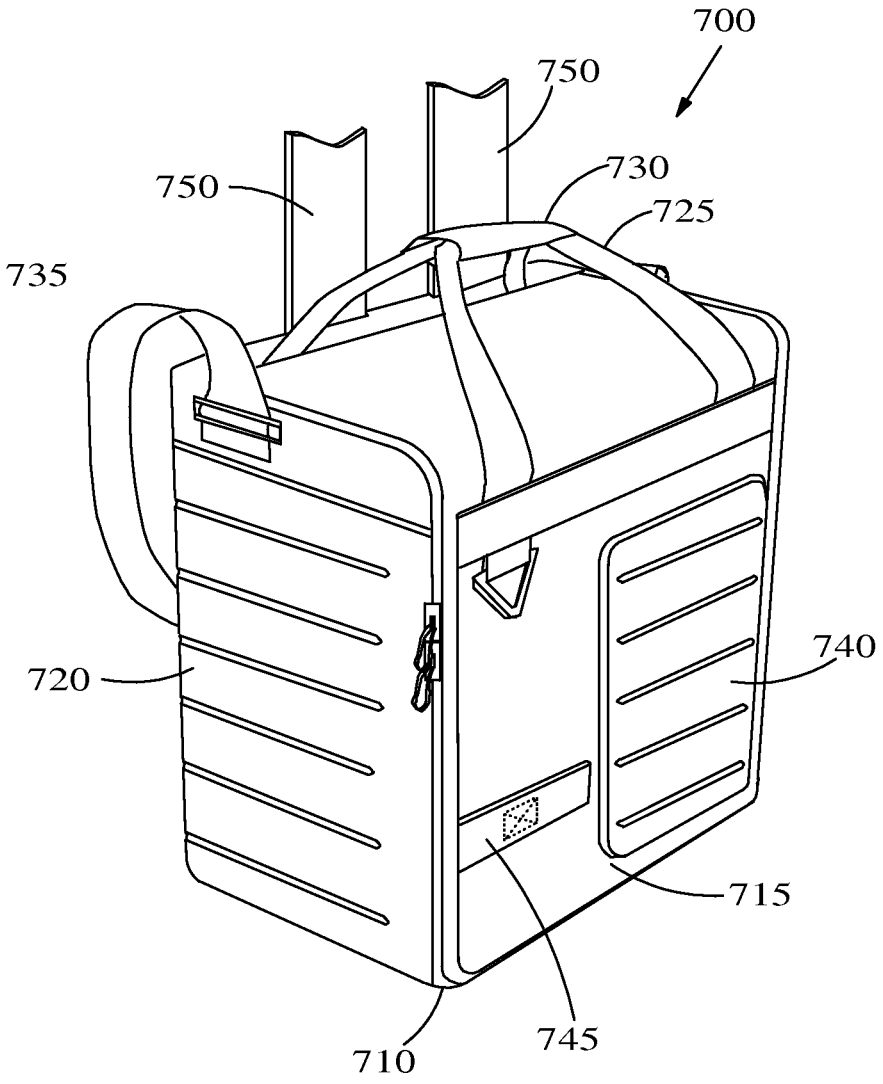
FIG. 13 is a front perspective view of a first embodiment of a boot bag according to the present disclosure.

FIGS. 12 and 13 depict an optional boot bag 700. Boot bag 700 includes an opening 710 to permit access to its interior. In the depicted embodiment, opening 710 extends across entire front 715 of boot bag 700. Although an opening 710 extending across the entire front 715 of boot bag 700 is depicted, opening 710 could be smaller and still be within the scope of the present disclosure. Moreover, opening 710 could be placed on the side, rear, top or bottom of boot bag 700 and still be within the scope of the present disclosure. In the depicted embodiment, opening 710 uses a zipper closure, but other means of closure, such as clips, buckles and the like could be substituted. Boot bag 700 includes a panel comprising compression molded ethylene vinyl acetate (EVA), which wraps around sides 720 and rear (not shown). The EVA panel provides an extra layer of padding to boot bag 700, providing an extra layer of protection to the contents of boot bag 700. Boot bag 700 includes a set of carrying straps 725 which can be enclosed in a cover 730 to form a handle. Cover 730 can attach over straps 725 using a number of conventional closure methods, such as hook and loop fasteners or snaps. Boot bag 700 also includes a shoulder strap 735. Optionally, boot bag 700 may include any number of miscellaneous pockets 740 and gear straps 745. Turning next to FIG. 13, boot bag 700 may optionally include one or more cutouts (not pictured). These cutouts allow skis 750 and/or snowboards to slide into the back of boot bag 700, which assists in holding skis and/or snowboards in place during travel. In use, boots are stacked in an interlocking manner inside boot bag 700 to reduce the storage volume.

Figure 14:
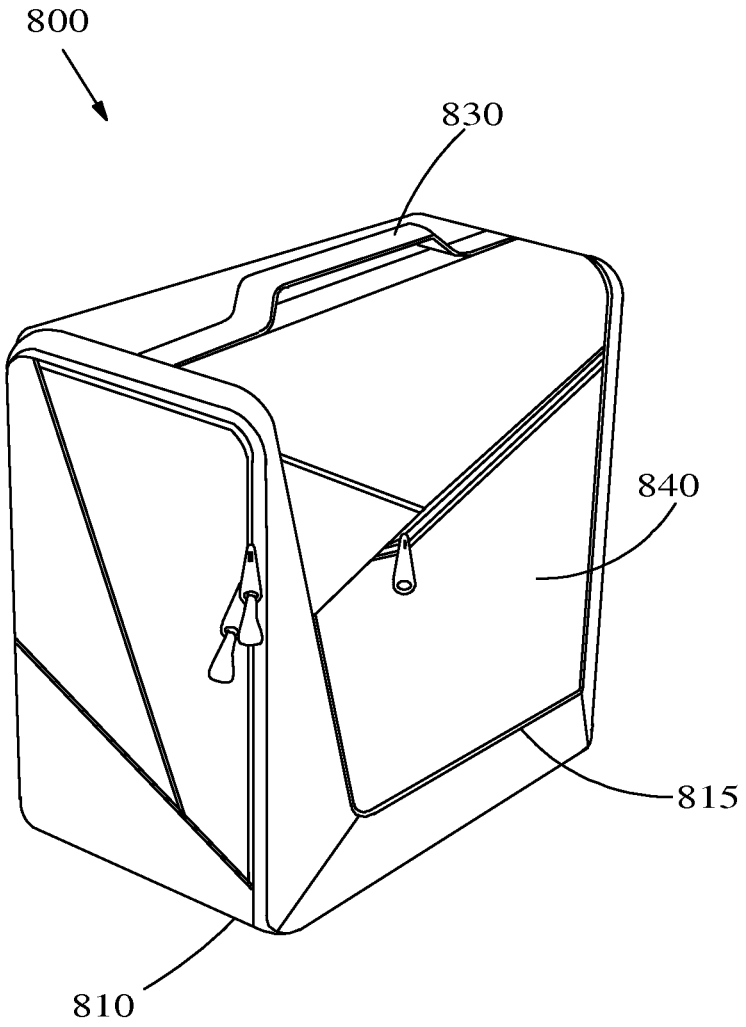
FIG. 14 is a front perspective view of a second embodiment of a boot bag according to the present disclosure.
Figure 15:
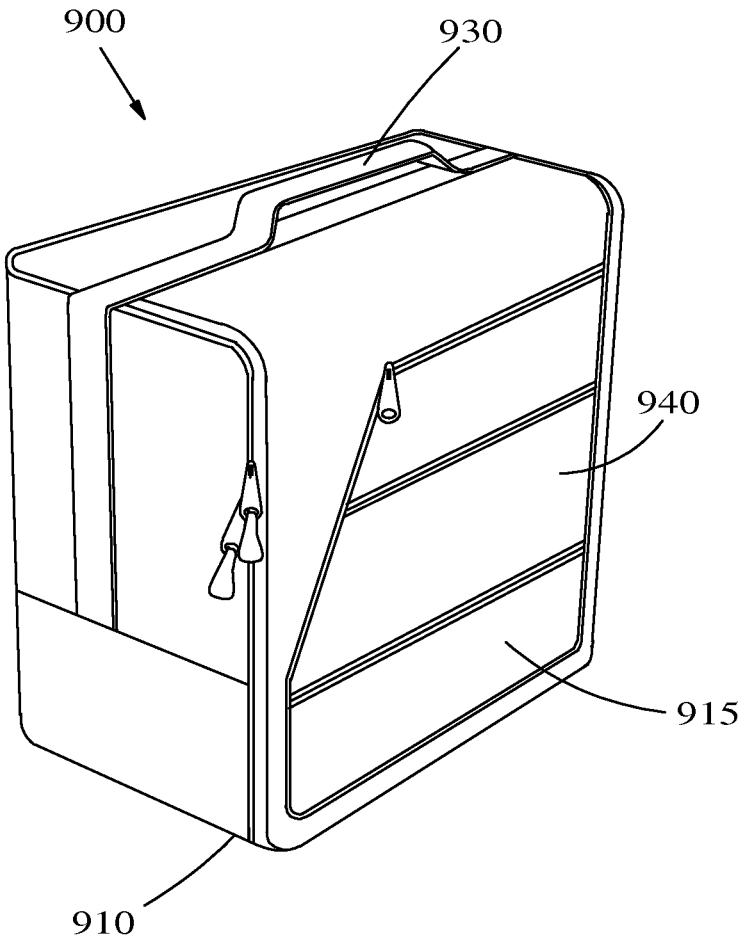
FIG. 15 is a front perspective view of a third embodiment of a boot bag according to the present disclosure.

FIGS. 14 and 15 depict alternate embodiments of boot bag 700. Turning first to FIG. 14, boot bag 800 includes an opening 810 to permit access to its interior. In the depicted embodiment, opening 810 extends across entire front 815 of boot bag 800. Although an opening 810 extending across the entire front 815 of boot bag 800 is depicted, opening 810 could be smaller and still be within the scope of the present disclosure. Moreover, opening 810 could be placed on the side, rear, top or bottom of boot bag 800 and still be within the scope of the present disclosure. In the depicted embodiment, opening 810 uses a zipper closure, but other means of closure, such as clips, buckles and the like could be substituted. A handle 830 is included on the top of boot bag 800. A pocket 840 is included on the front 815 of boot bag 800. In the depicted embodiment, pocket 840 includes a zippered closure. One having an ordinary level of skill in the art will understand that other closure mechanisms, such as snaps, hook and loop fasteners and buckle could be substituted. In use, boots are stacked in an interlocking manner inside boot bag 800 to reduce the storage volume.

Turning next to FIG. 15, boot bag 900 includes an opening 910 to permit access to its interior. In the depicted embodiment, opening 910 extends across entire front 915 of boot bag 900. In the depicted embodiment, opening 910 uses a zipper closure, but other means of closure, such as clips, buckles and the like could be substituted. Although an opening 910 extending across the entire front 915 of boot bag 900 is depicted, opening 910 could be smaller and still be within the scope of the present disclosure. Moreover, opening 910 could be placed on the side, rear, top or bottom of boot bag 900 and still be within the scope of the present disclosure. A handle 930 is included on the top of boot bag 900. A pocket 940 is included on the front 915 of boot bag 900. In the depicted embodiment, pocket 940 includes a zippered closure. One having an ordinary level of skill in the art will understand that other closure mechanisms, such as snaps, hook and loop fasteners and buckle could be substituted. In use, boots are stacked in an interlocking manner inside boot bag 900 to reduce the storage volume.

Figure 16:
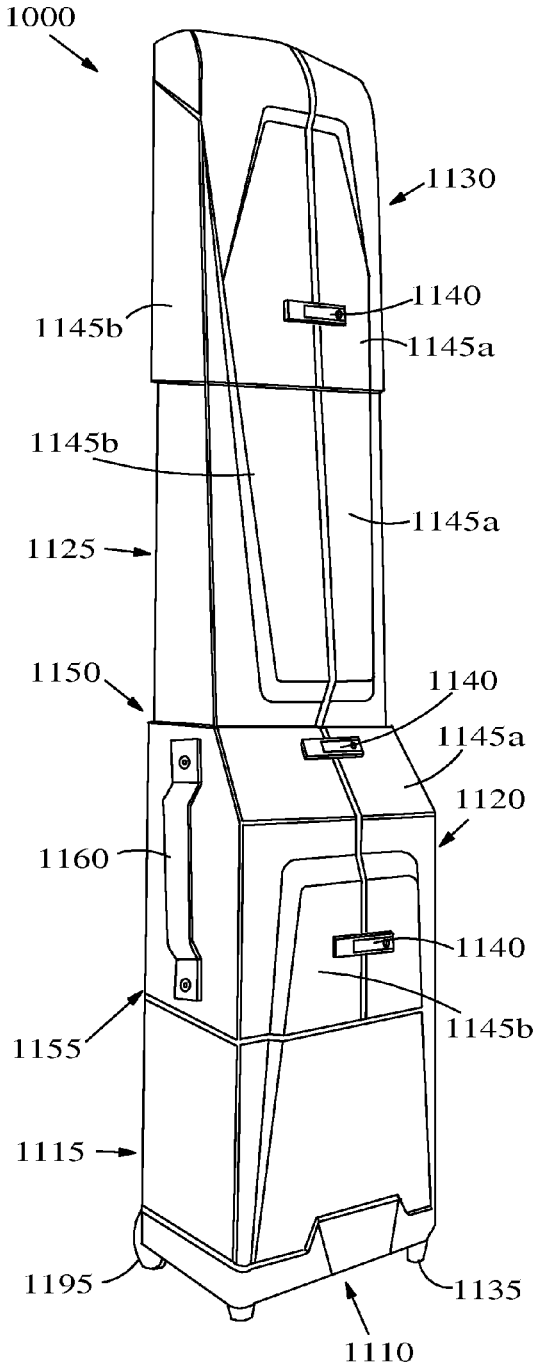
FIG. 16 is a front perspective view of a first telescoping embodiment of a portable snow sports equipment locker of the present disclosure in an extended position.

Turning next to FIG. 16, a telescoping embodiment of a portable snow sports equipment locker 1000 according to the present disclosure is shown. Portable snow sports equipment locker 1000 includes a base portion or section 1110, a first portion or section 1115, a second portion or section 1120, a third portion or section 1125, and a fourth portion or section 1130. Base portion or section 1110 includes two rear wheels 1195. While two wheels are shown, a portable snow sports equipment locker of the present disclosure may include four wheels, or no wheels, based on user needs and preference. Base portion or section 1110 also includes two legs 1135, which allow portable snow sports equipment locker 1000 to remain substantially level when in an upright position. Legs 1135 would not be necessary when portable snow sports equipment locker 1000 includes four wheels or no wheels.

Second portion or section 1120 comprises a varying depth, wherein the smallest depth is at the top 1150 of second portion or section 1120 and the largest depth is at the bottom 1155 of second portion or section 1120. This varying depth allows for the larger depth of first portion or section 1115 while maintaining a smaller depth at the top 1150 of second portion or section 1120 to transition to the third portion or section 1125 and fourth portion or section 1130. The varying depth allows portable snow sports equipment locker 1000 to maintain dimensions within the dimensional standards for standard shipping rates of major delivery companies, while still providing ample internal space. Second portion or section 1120, third portion or section 1125 and fourth portion or section 1130 include a set of doors 1145*a*, 1145*b*. Doors 1145*a*, 1145*b* extend the length of second portion or section 1120, third portion or section 1125 and fourth portion or section 1130. While doors 1145*a*, 1145*b* are depicted as extending the length of second portion or section 1120, third portion or section 1125 and fourth portion or section 1130, doors 1145*a*, 1145*b* could be shorter or longer and still be within the scope of the present disclosure. A series of latches 1140 secure doors 1145*a*, 1145*b* in a closed position. While latches are depicted, a number of known locking devices, such as locks, clips and buckles could be used and still be within the scope of the present disclosure. The embodiment disclosed in FIG. 16 includes three closures, but one having a level of ordinary skill in the art will understand that more or less closures could be used to accomplish the objective of retaining the doors in a closed position. Second portion or section 1120 also includes handles 1160. In FIG. 16, only one handle 1160 is visible. An identical handle 1160 is located on the opposite side of second portion or section 1120. Handles 1160 can comprise a number of known configurations.

Figure 17:
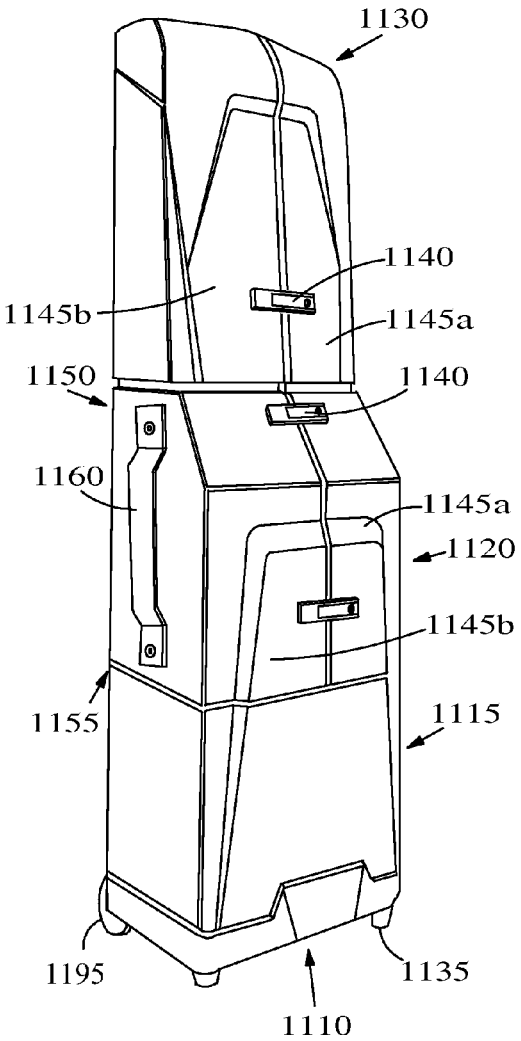
FIG. 17 is a front perspective view of a first telescoping embodiment of a portable snow sports equipment locker of the present disclosure in a collapsed position.

In the depicted embodiment, third portion or section 1125 is narrower than fourth portion or section 1130. A spine 1165 on the rear of portable snow sports equipment locker 1000 allows fourth portion or section 1130 to travel over third portion or section 1125 in a telescoping configuration. In this embodiment, third portion or section 1125 is fixed to second portion or section 1120. FIG. 16 depicts portable snow sports equipment locker 1000 in its extended configuration. FIG. 17 depicts portable snow sports equipment locker in it collapsed configuration. In the extended configuration depicted in FIG. 16, portable snow sports equipment locker 1000 is approximately 72 inches in height. In the collapsed configuration depicted in FIG. 17, portable snow sports equipment locker 1000 is approximately 50 inches in height.

Figure 18:
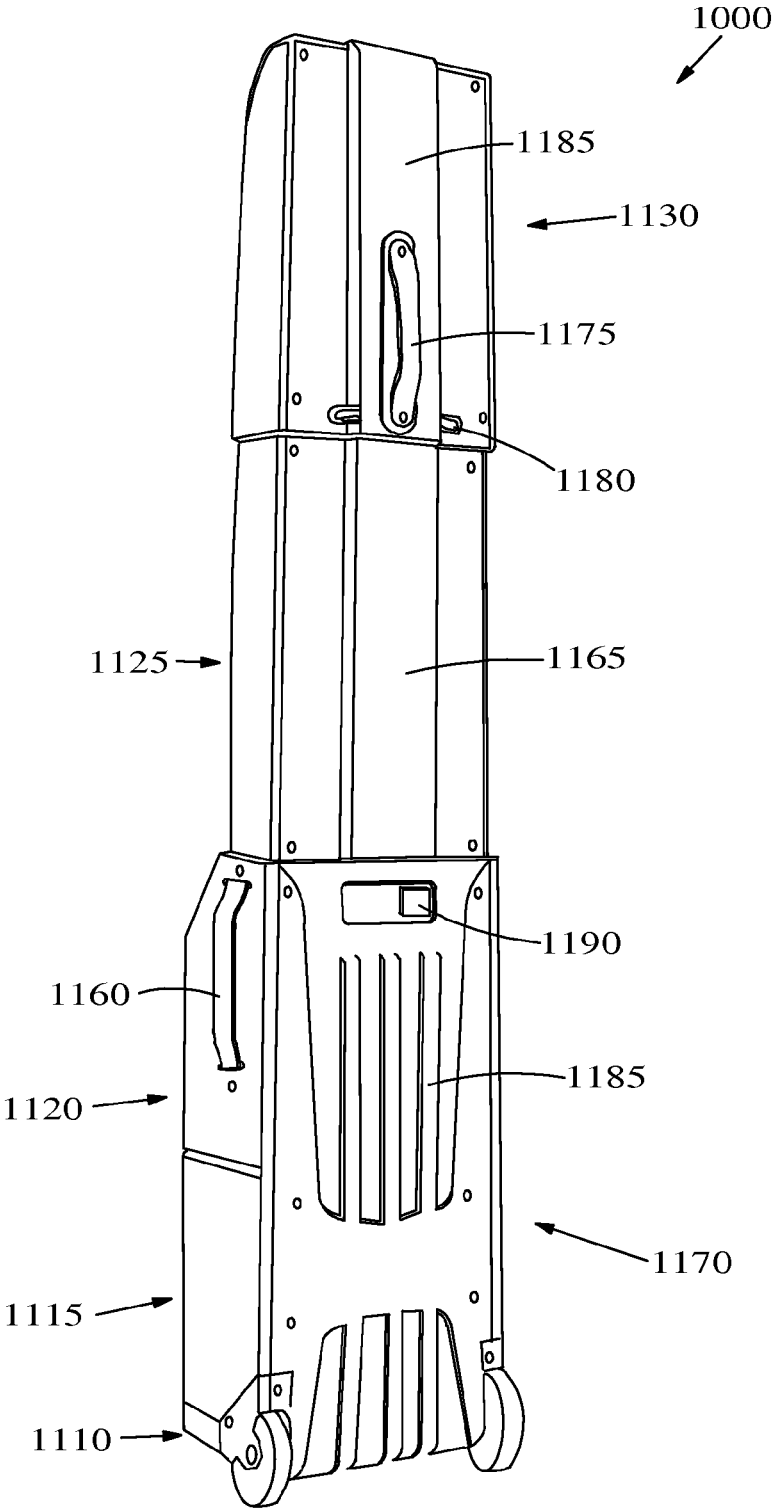
FIG. 18 is a rear perspective view of a first telescoping embodiment of a portable snow sports equipment locker of the present disclosure in an extended position.

Turning next to FIG. 18, the rear side of portable snow sports equipment locker 1000 is shown. From the rear, a handle 1175 is visible on fourth portion or section 1130. Release buttons 1180 are mounted on either side of a track 1185 extending the length of fourth portion or section 1130. A spine 1165 extends the length of third portion or section 1125. In use, release buttons 1180 are depressed, allowing fourth portion or section 1130 to travel up and down on spine 1165 by manipulating handle 1175. Portable snow sports equipment locker 1000 may then be locked in place, in either the extended position or the collapsed configuration. Handle 1175 may be mounted with room underneath or it may be mounted tightly to the portable snow sports equipment locker 1000 with the ability to be pulled out to gain additional clearance between handle 1175 and portable snow sports equipment locker 1000.

Base portion or section 1110, first portion or section 1115 and second portion or section 1120 share a common back panel 1170. Back panel 1170 includes a series of generally vertical bumpers 1185. Bumpers 1185 absorb minor impacts to portable snow sports equipment locker 1000, thereby offering an additional layer of protection to the portable snow sports equipment locker and its contents. Optionally, back panel may include an area 1190 for mounting traveler information and/or shipping information. In the depicted embodiment, back panel 1170 is molded. One having an ordinary level of skill in the art will understand that back panel 1170 could be formed using other similar processes.

Figure 19:
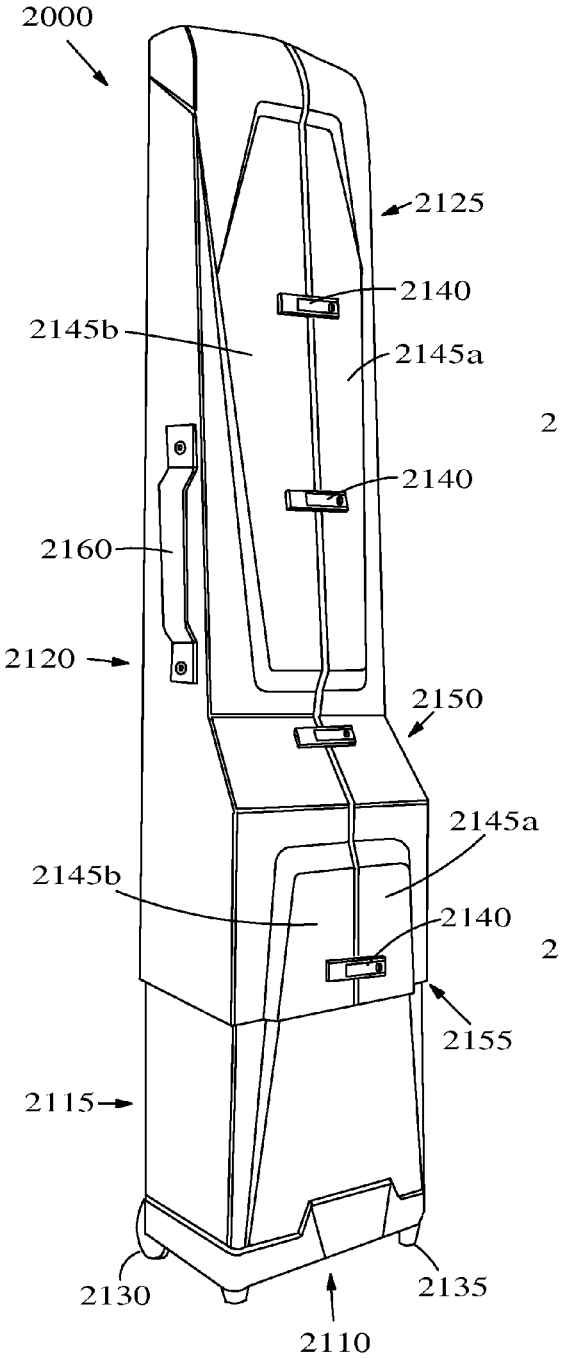
FIG. 19 is a front perspective view of a second telescoping embodiment of a portable snow sports equipment locker of the present disclosure in an extended position.

Turning next to FIG. 19, an alternate telescoping embodiment of a portable snow sports equipment locker 2000 according to the present disclosure is shown. Portable snow sports equipment locker 2000 includes a base portion or section 2110, a first portion or section 2115, a second portion or section 2120, and a third portion or section 2125. Base portion or section 2110 includes two rear wheels 2130. While two wheels are shown, a portable snow sports equipment locker of the present disclosure may include four wheels, or no wheels, based on user needs and preference. Base portion or section 2110 also includes two legs 2135, which allow portable snow sports equipment locker 2000 to remain substantially level when in an upright position. Legs 2135 would not be necessary when portable snow sports equipment locker 2000 includes four wheels or no wheels.

Second portion or section 2120 comprises a varying depth, wherein the smallest depth is at the top 2150 of second portion or section 2120 and the largest depth is at the bottom 2155 of second portion or section 2120. This varying depth allows for the larger depth of first portion or section 2115 while maintaining a smaller depth at the top of third portion or section 2125. The varying depth of second portion or section 2120 allows portable snow sports equipment locker 2000 to maintain dimensions within the dimensional standards of major delivery companies, while still providing ample internal space. Second portion or section 2120 and third portion or section 2125 include a set of doors 2145*a*, 2145*b*. Doors 2145*a*, 2145*b* extend the length of second portion or section 2120 and third portion or section 2125. While doors 2145*a*, 2145*b* are depicted as extending the length of second portion or section 2120 and third portion or section 2125, doors 2145*a*, 2145*b* could be shorter or longer and still be within the scope of the present disclosure. A series of latches 2140 secure doors 2145*a*, 2145*b* in a closed position. While latches are depicted, a number of known locking devices, such as locks, clips and buckles could be used and still be within the scope of the present disclosure. The embodiment disclosed in FIG. 19 includes three closures, but one having a level of ordinary skill in the art will understand that more or less closures could be used to accomplish the objective of retaining the doors in a closed position. Second portion or section 2120 also includes handles 2160. In FIG. 19, only one handle 2160 is visible. An identical handle 2160 is located on the opposite side of second portion or section 2120. Handles 2160 can comprise a number of known configurations.

Figure 20:
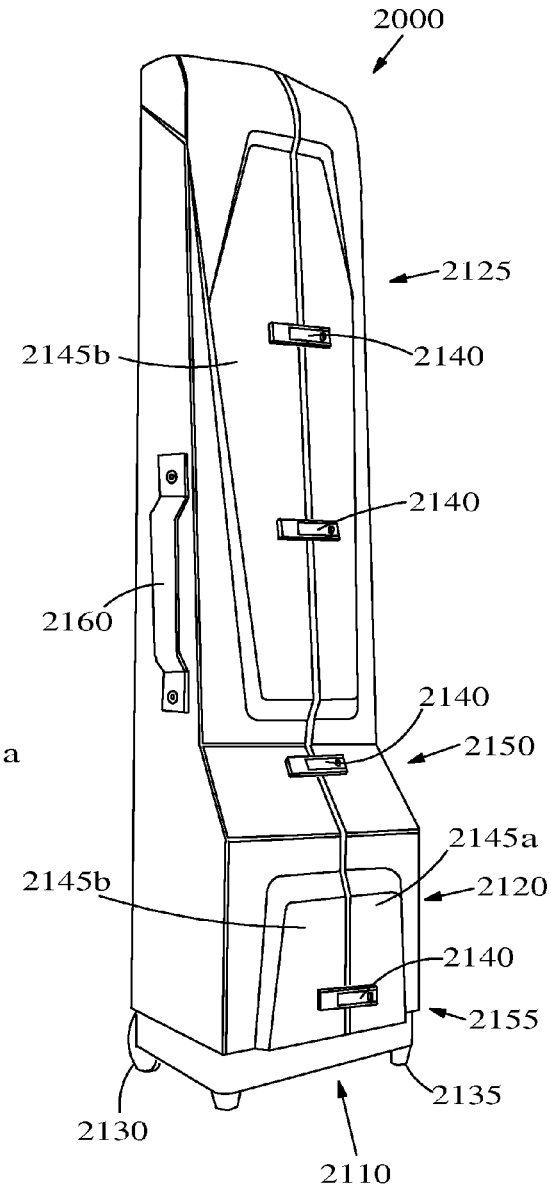
FIG. 20 is a front perspective view of a second telescoping embodiment of a portable snow sports equipment locker of the present disclosure in a collapsed position.

In the depicted embodiment, first portion or section 2115 is narrower than second portion or section 2120. A spine 2165 on the rear of portable snow sports equipment locker 2000 allows second portion or section 2120 to travel over first portion or section 2115 in a telescoping configuration. FIG. 19 depicts portable snow sports equipment locker 2000 in its extended configuration. FIG. 20 depicts portable snow sports equipment locker in it collapsed configuration. In the extended configuration depicted in FIG. 19, portable snow sports equipment locker 2000 is approximately 72 inches in height. In the collapsed configuration depicted in FIG. 20, portable snow sports equipment locker 2000 is approximately 50 inches in height.

Figure 21:
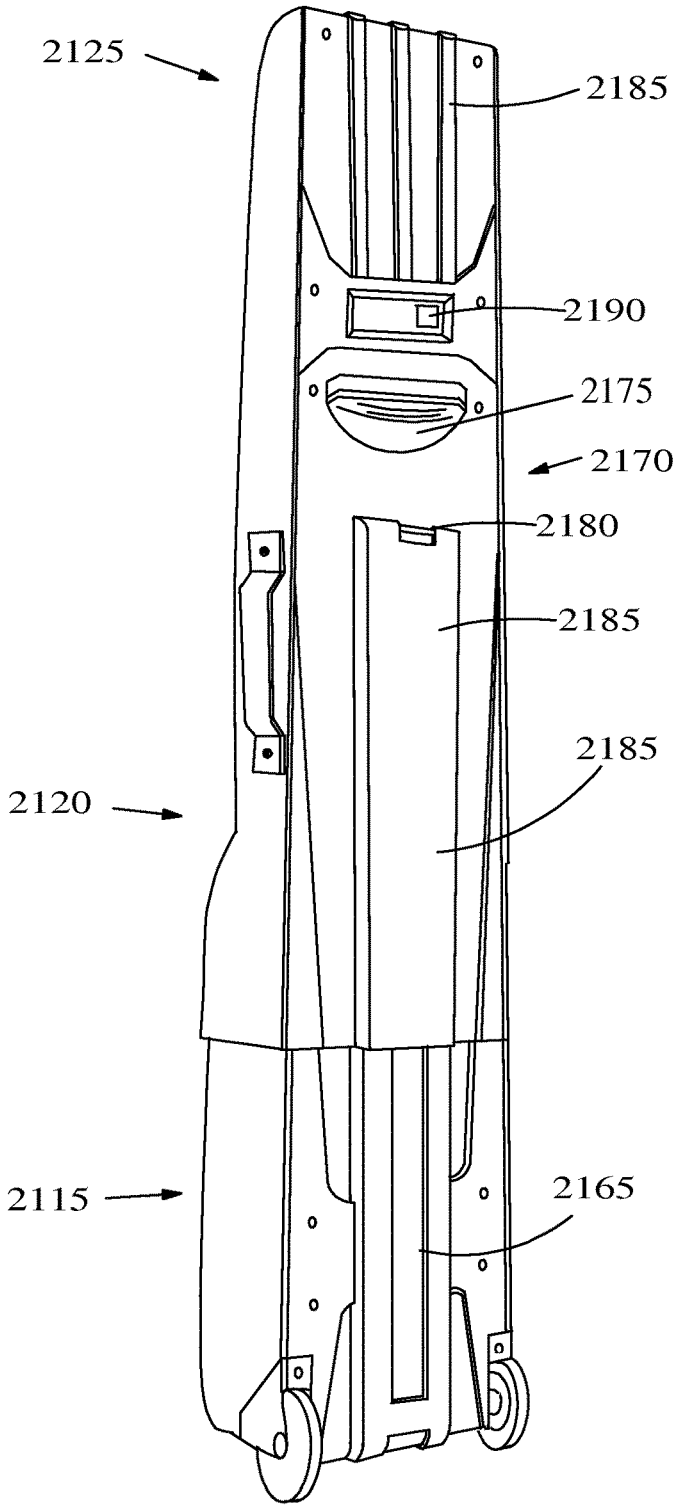
FIG. 21 is a rear perspective view of a second telescoping embodiment of a portable snow sports equipment locker of the present disclosure in an extended position.

Turning next to FIG. 21, the rear side of portable snow sports equipment locker 2000 is shown. Second portion or section 2120 and third portion or section 2125 share a common back panel 2170. Back panel 2170 includes a series of generally vertical bumpers 2185. Bumpers 2185 absorb minor impacts to portable snow sports equipment locker 1000, thereby offering an additional layer of protection to the portable snow sports equipment locker and its contents. Optionally, back panel may include an area 2190 for mounting traveler information and/or shipping information. In the depicted embodiment, back panel 2170 is molded. One having an ordinary level of skill in the art will understand that back panel 2170 could be formed using other similar processes.

A handle 2175 is present on back panel 2170. A release mechanism 2180 is mounted above a track 2185 extending the length of second portion or section 2120. A spine 2165 extends the length of first portion or section 2115. In use, release mechanism 2180 is depressed, allowing back panel to travel up and down on spine 2165 by manipulating handle 2175. Handle 2175 may be mounted with room underneath or it may be mounted tightly to the portable snow sports equipment locker 2000 with the ability to be pulled out to gain additional clearance between handle 2175 and portable snow sports equipment locker 2000. Portable snow sports equipment locker 2000 may then be locked in place, in either the extended position or the collapsed configuration.

The telescoping portable snow sports equipment locker depicted in FIGS. 16-21 offers numerous advantages. One such advantage is the ability to compact the portable snow sports equipment locker when it is empty. For example, the portable snow sports equipment locker can be loaned to customers for transporting ski equipment to an alternate location. When an empty portable snow sports equipment locker is shipped to a customer, the telescoping portion or section can be compacted. Reducing the volume of the portable snow sports equipment locker reduces the shipping cost. Upon receipt, the consumer can expand and fill the portable snow sports equipment locker for shipping to his or her chosen destination. The portable snow sports equipment locker is then shipped via any known shipping method, which has been pre-selected by the user, using a prepaid shipping label provided with the portable snow sports equipment locker. Advantageously, the portable snow sports equipment locker can be shipped at standard rates, even in its expanded form. The consumer can elect to have the portable snow sports equipment locker retrieved from his or her home by the shipping company. Alternatively, the consumer can take the portable snow sports equipment locker to a shipping company's physical location for shipping. The user is then reunited with the portable snow sports equipment locker at his or her chosen location. When a consumer leaves the chosen destination, he or she simply repacks the portable snow sports equipment locker and deposits it with the shipping company, or, in the alternative, with the hotel in which he or she is staying. Again, the consumer may utilize a prepaid shipping label, once again taking advantage of standard shipping rates. When the consumer arrives at his or her next chosen location, he or she simply unpacks the portable snow sports equipment locker, compacts the telescoping portion or section and releases it to a shipping company for return. The consumer may utilize a prepaid shipping label. Once again, the reduced volume of the portable snow sports equipment locker reduces the shipping charge, and the size of the portable snow sports equipment locker allows the consumer to take advantage of standard shipping rates.

One having an ordinary level of skill in the art will understand that the release mechanisms depicted in portable snow sports equipment lockers 1000 and 2000 are interchangeable.

Each of the portable snow sports equipment lockers described in the present disclosure may optionally comprise a monocoque or semi-monocoque frame. This hard exterior provides protection to the enclosed equipment while also standardizing the container's volume to ensure optimal shipping prices. Each embodiment may also include spring hinged locker doors.

A portable snow sports equipment locker comprises a base portion; a lower portion; an upper portion; at least one of said portions having a door; wherein at least one of said portions comprises a varying depth; wherein said portions comprise a single unit; and wherein the interior of any portion can be accessed from the interior of any other portion. The portable snow sports equipment locker further comprises one or more wheels and/or legs affixed to one or more of said portions. The portable snow sports equipment locker of claim further comprises one or more ridges and/or raised portions formed on one or more of said portions. The portable snow sports equipment locker further comprises a set of doors. The portable snow sports equipment locker further comprises one or more latches to secure said set of doors. The portable snow sports equipment locker further comprises one or more handles affixed to one or more of said portions. The portable snow sports equipment locker further comprises a locking mechanism affixed to the interior of one or more of said portions, wherein said locking mechanism traps snow sports equipment against a wall of said interior of said one or more portions. The portable snow sports equipment locker of further comprises a boot bag sized to fit in one of said portions. The portable snow sports equipment locker further comprises one or more interior pockets and/or interior straps in one or more of said portions. The portable snow sports equipment locker, wherein one or more of said portions comprise a monocoque structure. The portable snow sports equipment locker, wherein said portable snow sports equipment locker is sized to be shipped at standard shipping rates. The portable snow sports equipment locker, wherein said portable snow sports equipment locker is sized to contain all of at least one user's snow sports gear. The portable snow sports equipment locker, wherein said gear comprises gloves, goggles, helmets, boots and ski clothing. The portable snow sports equipment locker further comprising a molded back panel. The portable snow sports equipment locker further comprising protective material on one or more interior surface. The portable snow sports equipment locker further comprising a lined goggle compartment.

A portable snow sports equipment locker comprises a base portion; a first portion; a second portion; a third portion; at least one of said portions having a door; wherein at least one of said portions comprises a varying depth; wherein at least one portion is narrower than at least one adjacent portion; and wherein said adjacent portion can travel over said narrower portion in a telescoping configuration. The portable snow sports equipment locker further comprises one or more wheels and/or legs affixed to one or more of said portions. The portable snow sports equipment locker further comprises one or more ridges and/or raised portions formed on one or more of said portions. The portable snow sports equipment locker further comprises a set of doors. The portable snow sports equipment locker further comprising one or more latches to secure said set of doors. The portable snow sports equipment locker further comprises one or more handles affixed to one or more of said portions. The portable snow sports equipment locker further comprising a locking mechanism affixed to the interior of one or more of said portions; wherein said locking mechanism traps snow sports equipment against a wall of said interior of said one or more portions. The portable snow sports equipment locker further comprising a boot bag sized to fit in one of said portions. The portable snow sports equipment locker further comprising one or more interior pockets and/or interior straps in one or more of said portions. The portable snow sports equipment locker wherein one or more of said portions comprise a monocoque structure. The portable snow sports equipment locker, wherein said portable snow sports equipment locker is sized to be shipped at standard shipping rates. The portable snow sports equipment locker, wherein said portable snow sports equipment locker is sized to contain all of at least one user's snow sports gear. The portable snow sports equipment locker, wherein said gear comprises gloves, goggles, helmets, boots and ski clothing. The portable snow sports equipment locker further comprising a molded back panel. The portable snow sports equipment locker further comprising protective material on one or more interior surface. The portable snow sports equipment locker further comprising a lined goggle compartment.

A container comprising a front surface; a back surface; two sides; a base; and a space defined by said front and back surfaces; said front surface positioned at distance from said back surface which varies in a tapered fashion; and a portion of said front surface having at least one door. The container further comprises one or more wheels and/or legs affixed to one or more of said surfaces, sides or base. The container further comprises one or more ridges and/or raised portions formed on one or more of said surfaces, sides or base. The container further comprises a set of doors. The container further comprises one or more latches to secure said set of doors. The container further comprises one or more handles affixed to one or more of said surfaces, sides or base. The container further comprises a locking mechanism affixed to the interior of one or more of said surfaces, sides or base; wherein said locking mechanism traps snow sports equipment against a wall of said interior of said one or more surfaces, sides or base. The container further comprises a boot bag sized to fit in said space defined by said front and back surfaces. The container further comprises one or more interior pockets and/or interior straps on one or more of said surfaces, sides or base. The container wherein one or more of said surfaces, sides or base comprise a monocoque structure. The container, wherein said container is sized to be shipped at standard shipping rates. The container, wherein said portable snow sports equipment locker is sized to contain all of a user's snow sports gear. The container, wherein said gear comprises gloves, goggles, helmets, boots and ski clothing. The container, wherein said container comprises at least two portions and wherein at least one portion is narrower than at least one adjacent portion; and wherein said adjacent portion can travel over said narrower portion in a telescoping configuration. The container further comprising a molded back panel. The container further comprising protective material on one or more interior surface. The container further comprising a lined goggle compartment.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention. Consistent with the plain meaning and conventional definition of the term, the "longitudinal axis" of the portable snow sports equipment locker refers to the axis that runs lengthwise through the center of the locker (e.g. if the locker is stood upright on a horizontal surface, the longitudinal axis of the locker would extend vertically).

All patents and publications mentioned in the specification are indicative of the levels of skill of those skilled in the art to which the invention pertains. All references cited herein are hereby incorporated by reference to the extent that there is no inconsistency with the disclosure of this specification. Some references provided herein are incorporated by reference herein to provide details concerning additional starting materials, additional methods of synthesis, additional methods of analysis and additional uses of the invention.

We claim:

1. A portable snow sports equipment locker comprising:
- a base portion;
- a first portion adjacent to the base portion;
- a second portion adjacent to the first portion;
- a third portion adjacent to the second portion;
- wherein at least one set of doors is formed on at least the second portion and the third portion;
- wherein said portions are structurally integrated and form a monocoque structure;
- wherein at least the second portion and the third portion taper such that at least a majority of the snow sports equipment locker has a reduced depth along its longitudinal axis;

wherein at least one portion is narrower than at least one adjacent portion, such that said adjacent portion can travel over said narrower portion in a telescoping configuration; and wherein the portable snow sports equipment locker comprises a total volume less than or equal to approximately 5130 cubic inches.

2. The portable snow sports equipment locker of claim 1, further comprising a boot bag sized to fit in at least one of said portions, wherein said boot bag is configured to hold a pair of boots when placed inside the portable snow sports equipment locker.

3. The portable snow sports equipment locker of claim 2, wherein a back of the boot bag comprises at least one cutout configured to receive an end of one or more skis or snowboard.

4. The portable snow sports equipment locker of claim 1, further comprising one or more ridges and/or raised portions formed on an exterior of one or more of said portions.

5. The portable snow sports equipment locker of claim 1, further comprising a locking mechanism affixed to an interior of one or more of said portions; wherein said locking mechanism traps snow sports equipment against a wall of said interior of said one or more portions.

6. The portable snow sports equipment locker of claim 1, wherein the at least one set of doors extend along an entire longitudinal axis through the second portion and the third portion.

7. The portable snow sports equipment locker of claim 1, wherein the base portion and the first portion do not comprise any part of the at least one set of doors.

8. The portable snow sports equipment locker of claim 1, wherein the second portion can travel over the first portion in the telescoping configuration.

9. The portable snow sports equipment locker of claim 1, further comprising a fourth portion, wherein the fourth portion can travel over the third portion in the telescoping configuration.

10. The portable snow sports equipment locker of claim 1, wherein the portable snow sports equipment locker is configured to be able to stand vertically upright when the base portion is placed on a substantially horizontal surface.

11. The portable snow sports equipment locker of claim 1, wherein the telescoping configuration can vary a height of the snow sports equipment locker over a range of approximately 50 to 72 inches.

* * * * *